US009939758B2

(12) United States Patent
Adachi et al.

(10) Patent No.: US 9,939,758 B2
(45) Date of Patent: Apr. 10, 2018

(54) DEVELOPING DEVICE, AND IMAGE FORMING APPARATUS AND PROCESS CARTRIDGE INCORPORATING SAME

(71) Applicants: Takahiro Adachi, Kanagawa (JP); Akira Fujimori, Kanagawa (JP); Yutaka Takahashi, Kanagawa (JP); Daisuke Hamada, Kanagawa (JP)

(72) Inventors: Takahiro Adachi, Kanagawa (JP); Akira Fujimori, Kanagawa (JP); Yutaka Takahashi, Kanagawa (JP); Daisuke Hamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/593,010

(22) Filed: May 11, 2017

(65) Prior Publication Data

US 2017/0336733 A1 Nov. 23, 2017

(30) Foreign Application Priority Data

May 20, 2016 (JP) ..... 2016-101803
Feb. 9, 2017 (JP) ..... 2017-022556

(51) Int. Cl.
*G03G 15/08* (2006.01)
*G03G 21/10* (2006.01)
*G03G 15/09* (2006.01)

(52) U.S. Cl.
CPC ..... *G03G 15/0889* (2013.01); *G03G 15/0891* (2013.01); *G03G 15/09* (2013.01); *G03G 21/105* (2013.01)

(58) Field of Classification Search
CPC ..... G03G 15/0889; G03G 15/0891; G03G 15/09; G03G 21/105
USPC ..... 399/256
See application file for complete search history.

(56) References Cited

U.S. PATENT DOCUMENTS

2016/0124346 A1 5/2016 Yamabe et al.
2016/0306300 A1 10/2016 Hamada et al.
2016/0342134 A1 11/2016 Shiori et al.

FOREIGN PATENT DOCUMENTS

JP 11167256 A * 6/1999
JP 2002-072686 3/2002
JP 2015-215369 12/2015

* cited by examiner

*Primary Examiner* — Susan Lee
(74) *Attorney, Agent, or Firm* — Duft Bornsen & Fettig LLP

(57) ABSTRACT

A developing device includes a developer container to contain developer including toner and magnetic carrier, the developer container; a developer bearer to carry, by rotation, the developer to a developing range facing a latent image bearer; a communication opening in a wall defining the developer container; a toner conveyance passage connected to the communication opening; and a cylindrical magnet having a magnetic pole arrangement parallel to an axis of the cylindrical magnet. The cylindrical magnet is disposed to enclose a space overlapping with the communication opening on a cross section perpendicular to the axis of the cylindrical magnet.

9 Claims, 21 Drawing Sheets

DEVELOPING DEVICE, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. § 119(a) to Japanese Patent Application Nos. 2016-101803, filed on May 20, 2016, and 2017-022556, filed on Feb. 9, 2017, in the Japan Patent Office, the entire disclosure of each of which is hereby incorporated by reference herein.

BACKGROUND

Technical Field

Embodiments of the present disclosure generally relate to a developing device, and a process cartridge and an image forming apparatus, such as a copier, a printer, a facsimile machine, or a multifunction peripheral having at least two of copying, printing, facsimile transmission, plotting, and scanning capabilities, that include the developing device.

Description of the Related Art

Developing devices typically include a developing roller (i.e., a developer bearer) inside which a magnet roller is disposed and a casing having an opening. Through the opening, the developing roller is exposed and positioned opposite a photoconductor serving as a latent image bearer. Such developing devices develop a latent image on the photoconductor with powdered toner carried on the portion of the developing roller exposed from the opening.

SUMMARY

According to an embodiment of this disclosure, a developing device includes a developer container to contain developer including toner and magnetic carrier, the developer container; a developer bearer to carry, by rotation, the developer to a developing range facing a latent image bearer; a communication opening in a wall defining the developer container; a toner conveyance passage connected to the communication opening; and a cylindrical magnet having a magnetic pole arrangement parallel to an axis of the cylindrical magnet. The cylindrical magnet is disposed such that a space enclosed by an inner face of the cylindrical magnet overlaps with the communication opening, on a cross section perpendicular to the axis of the cylindrical magnet.

In another embodiment, an image forming apparatus includes the latent image bearer to bear a latent image; and the developing device described above, to develop the latent image with the toner into a toner image.

Another embodiment provides a process cartridge to be removably installed in an image forming apparatus. The process cartridge includes the latent image bearer to bear a latent image, the developing device described above, and a holder to hold the latent image bearer and the developing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
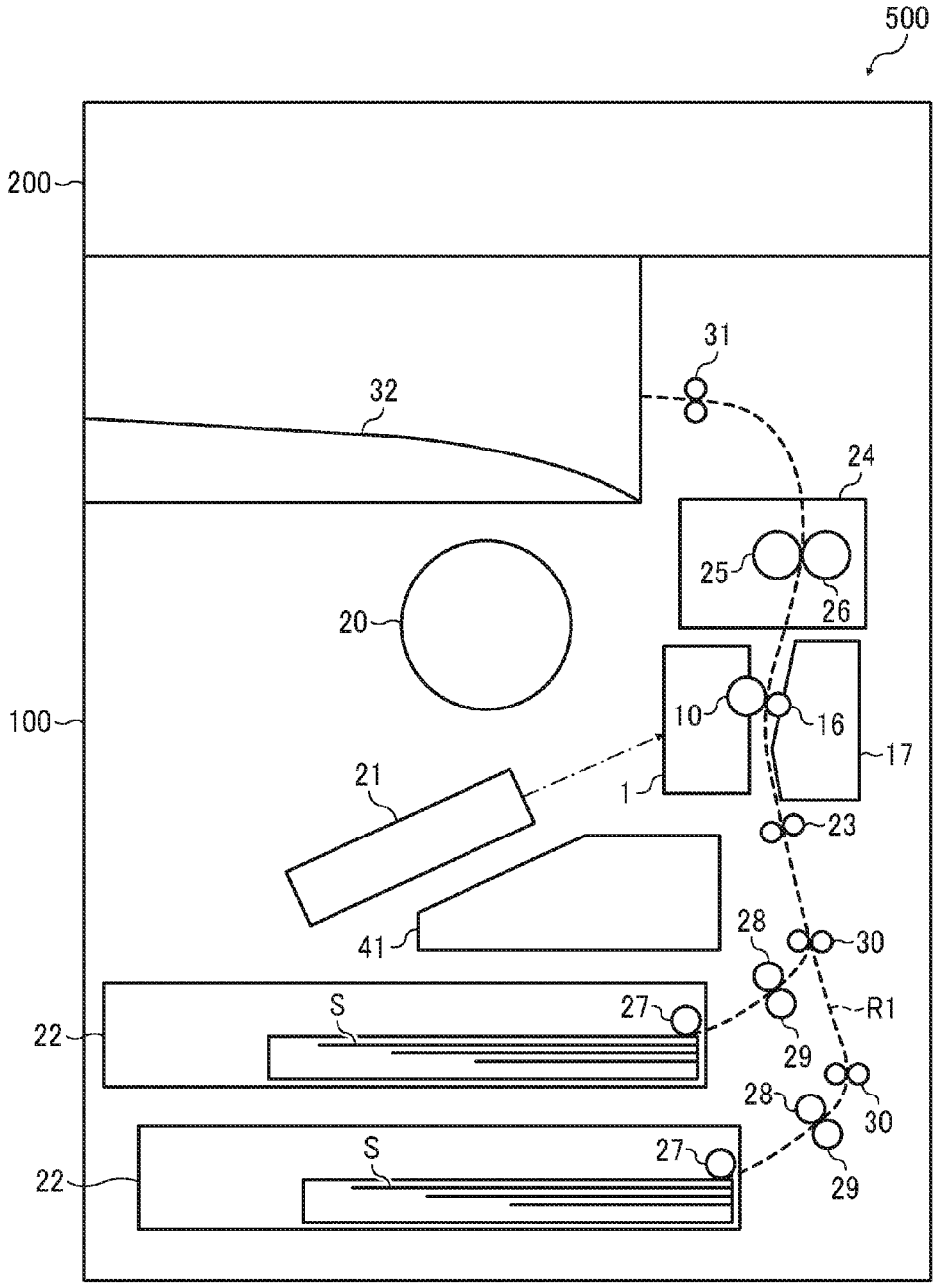
FIG. 1 is a schematic configuration of an image forming apparatus according to an embodiment of the present invention.

The accompanying drawings are intended to depict embodiments of the present invention and should not be interpreted to limit the scope thereof The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

FIG. 1 is a schematic view of an image forming apparatus 500 according to an embodiment.

For example, the image forming apparatus 500 is a copier and includes a scanner 200 (i.e., an image reading device) disposed above an apparatus body 100.

The apparatus body 100 includes a process cartridge 1.

Figure 2A:
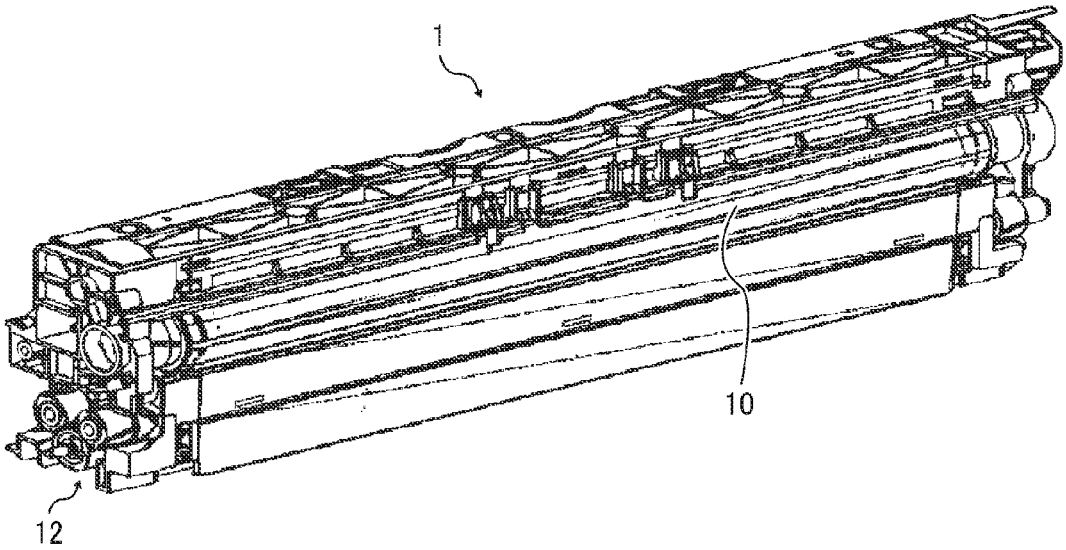
FIG. 2A is a perspective view of a process cartridge of the image forming apparatus illustrated in FIG. 1.
Figure 2B:
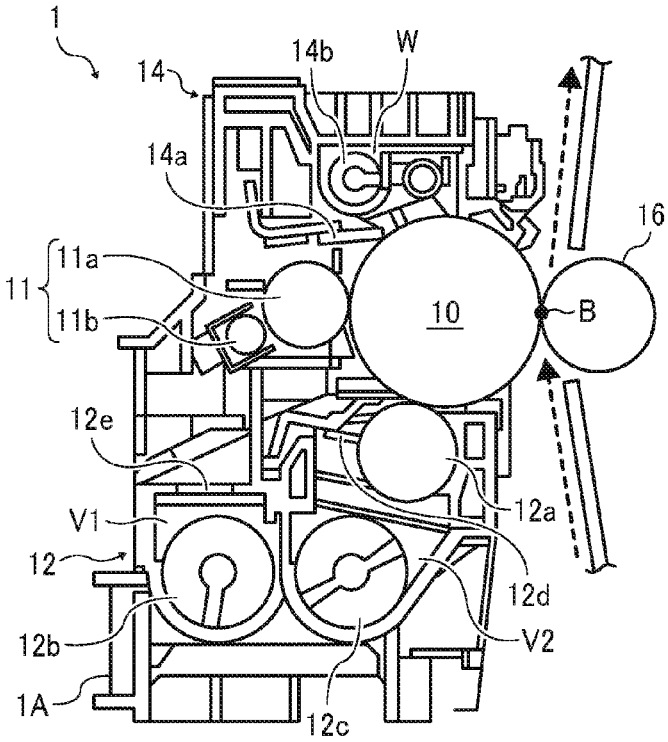
FIG. 2B is a cross-sectional view of the process cartridge illustrated in FIG. 2A.

FIG. 2A is a perspective view of the process cartridge 1, and FIG. 2B is a cross-sectional view of the process cartridge 1.

As illustrated in FIG. 2B, the process cartridge 1 includes a photoconductor 10 serving as a latent image bearer. Around the photoconductor 10, devices to execute image forming processes on the photoconductor 10, namely, a charging device 11, a developing device 12, and a cleaning device 14 are disposed, housed in a common holder 1A. The process cartridge 1 is removably mountable in the apparatus body 100. When the photoconductor 10, the charging device 11, the developing device 12, and the cleaning device 14 are united into the process cartridge 1, replacement work and maintenance work can be easier. Additionally, in the process cartridge 1, the relative positions of the components can be kept at a higher degree of accuracy, thus enhancing the quality of images produced.

The charging device 11 (i.e., a charger) includes a charging roller 11*a* and a removing roller 11*b*. A charging bias is applied to the charging roller 11*a*, and the charging roller 11*a* gives electrical charges to the surface of the photoconductor 10 to uniformly charge the photoconductor 10. The removing roller 11*b* removes substances, such as toner, adhering to the surface of the charging roller 11*a*.

The developing device 12 includes a first developer compartment V1 (a developer containing compartment), in which a first conveying screw 12*b* serving as a developer conveyor is disposed. The first conveying screw 12*b* has a spiral blade 12*b* 4 (illustrated in FIG. 19). The developing device 12 further includes a second developer compartment V2. In the second developer compartment V2, a second conveying screw 12*c* serving as another developer conveyor, a developing roller 12*a*, serving as a developer bearer, and a developer doctor 12*d* serving as a developer regulator are disposed. For example, the developer doctor 12*d* is blade-shaped.

The first and second developer compartments V1 and V2 contain two-component developer including magnetic carrier and negatively charged toner. Being rotated by a driver, the first conveying screw 12*b* transports the developer inside the first developer compartment V1 to the front side of the paper on which FIG. 2A is drawn. At the end of the first developer compartment V1 on the front side, the developer transported by the first conveying screw 12*b* enters the second developer compartment V2.

Being rotated by the driver, the second conveying screw 12*c* inside the second developer compartment V2 transports the developer to the back side of the paper on which FIG. 2A is drawn. At a position above or higher than the second conveying screw 12*c*, the developing roller 12*a* is disposed parallel to the second conveying screw 12*c*. The developing roller 12*a* includes a nonmagnetic developing sleeve that rotates and a stationary magnet roller disposed inside the developing sleeve.

A portion of the developer transported by the second conveying screw 12*c* is scooped onto the surface of the developing roller 12*a* due to the magnetic force exerted by the magnet roller. The developer doctor 12*d* is disposed across a predetermined gap from the surface of the developing roller 12*a* and adjusts the thickness of a layer of developer carried on the developing roller 12*a*, after which the developer is transported to a developing range B facing the photoconductor 10. Then, toner adheres to the electrostatic latent image on the photoconductor 10. Thus, a toner image is formed on the photoconductor 10. After the toner therein is thus consumed, the developer is returned to the second conveying screw 12*c* as the developing roller 12*a* rotates. The developer transported to the end of the second developer compartment V2 by the second conveying screw 12*c* is returned to the first developer compartment V1. Thus, the developer is circulated inside the developing device 12.

The developing device 12 further includes a toner concentration sensor 124 (illustrated in FIG. 5) to detect the concentration (or percentage) of toner in the developer in the first developer compartment V1. For example, the toner concentration sensor 124 measures the toner concentration based on the magnetic permeability of the developer. As the toner concentration decreases, the magnetic carrier becomes denser, and the magnetic permeability increases. When a value detected by the toner concentration sensor 124 deviates from a target value (threshold), toner is supplied from a toner bottle 20 (illustrated in FIG. 1), serving as a toner container, to the developing device 12 to keep the toner concentration constant or substantially constant. For the target value, a toner pattern is formed on the photoconductor 10, and an optical sensor detects the amount of toner adhering to the toner pattern. The target value is determined based on the detected toner adhesion amount.

Although this operation is performed to keep the density of the toner pattern (i.e., a reference pattern) on the photoconductor 10 constant, decreases in the density are inevitable when the toner bottle 20 becomes empty. In such a situation, even if the operation to supply the toner from the toner bottle 20 is executed for a certain length of time, the toner adhesion amount of the toner pattern, detected by the optical sensor, does not recover. Accordingly, in a case where the toner adhesion amount of the toner pattern, detected by the optical sensor, does not recover despite the operation to supply the toner from the toner bottle 20, a controller 60 (i.e., a determiner) illustrated in FIG. 17 of the image forming apparatus 500 determines (or estimates) that there is no toner (toner end).

After the toner bottle 20 is replaced in response to the determination of "toner end", the following operation is executed to supply toner from the toner bottle 20 to the developing device 12. The developing roller 12*a* and the first and second conveying screws 12*b* and 12*c* illustrated in FIG. 2B are rotated to mix the supplied toner with the developer. At that time, to prevent uneven sliding of the developer borne on the developing roller 12*a*, the photoconductor 10 is rotated.

The cleaning device 14 includes a cleaning blade 14*a* that contacts or abuts against the photoconductor 10 to scrape off the toner adhering to the photoconductor 10 after a transfer process. The cleaning device 14 further includes a toner collecting coil 14*b* disposed in a collected toner compartment W to transport the toner collected by the cleaning blade 14*a*. The collected toner is further transported by a toner conveyance device 50 (illustrated in FIG. 6) to either the developing device 12 or a waste-toner container 41 (illustrated in FIG. 1).

A transfer device 17 illustrated in FIG. 1 includes a transfer roller 16 pressed to the surface of the photoconductor 10. Above the transfer device 17, a thermal fixing device 24 is disposed. The fixing device 24 includes a heating roller 25 and a pressure roller 26. The apparatus body 100 further contains a laser writing device 21 serving as a latent image forming device. The laser writing device 21 includes a laser light source, a polygon mirror for scanning, a polygon motor, and an fθ lens. The apparatus body 100 further contains sheet trays 22 stacked one on another, to store sheets S of recording media such as paper and overhead projector (OHP) transparencies.

To make copies using the image forming apparatus 500 configured as described above, when a user presses a start button, the scanner 200 reads the contents of the document set therein. Simultaneously, a photoconductor driving motor drives the photoconductor 10, and the charging device 11 (refer to FIG. 2B) including the charging roller lla uniformly charges the surface of the photoconductor 10. Subsequently, the laser writing device 21 emits a laser beam according to the contents of the document scanned by the scanner 200, thus writing a latent image on the photoconductor 10. The developing device 12 (see FIGS. 2A and 2B) develops the electrostatic latent image with the toner into a visible image.

When the user presses the start button, a pickup roller 27 sends out the sheet S (i.e., a transfer medium) from the selected sheet tray 22. One sheet S is separated from the rest by a sheet feeding roller 28 and a separation roller 29 and fed to a feeding path R1. In the feeding path R1, multiple conveyance roller pairs 30 transport the sheet S, and the sheet S is caught in a registration roller pair 23. The registration roller pair 23 forwards the sheet S to a transfer nip, where the transfer roller 16 contacts the photoconductor 10, timed to coincide with the arrival of the toner image on the photoconductor 10.

In the transfer nip, the transfer device 17 transfers the toner image onto the sheet S from the photoconductor 10. The cleaning device 14 (see FIG. 2B) removes the toner remaining on the photoconductor 10 after the image transfer, and a discharger removes residual potentials from the photoconductor 10. Then, the apparatus is prepared for subsequent image formation started by the charging device 11 (see FIG. 2B).

Meanwhile, the sheet S is guided to the fixing device 24. While passing between the heating roller 25 and the pressure roller 26, the sheet S is heated and pressed to fix the toner image on the sheet S. Subsequently, an ejection roller pair 31 discharges the sheet S to a sheet stack section 32.

Next, a configuration and operation of the developing device 12 illustrated in FIG. 2A is described in further detail below.

Figure 3:
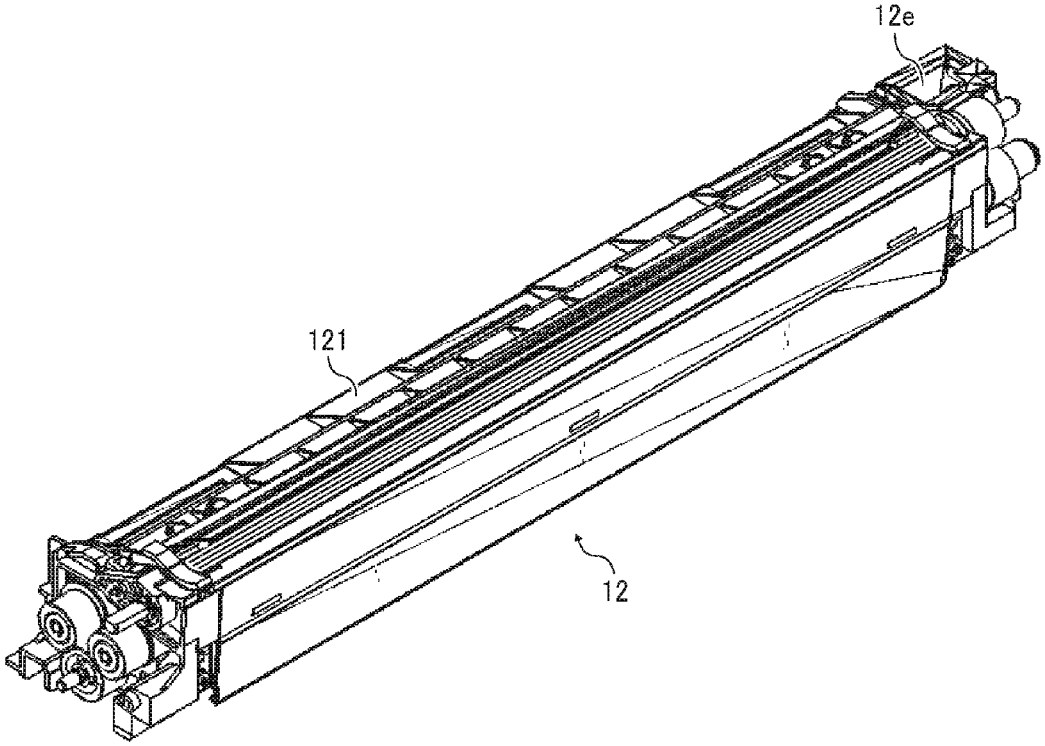
FIG. 3 is a perspective view illustrating an exterior of a developing device according to an embodiment.

FIG. 3 is a perspective view that illustrates an exterior of the developing device 12.

Figure 4:
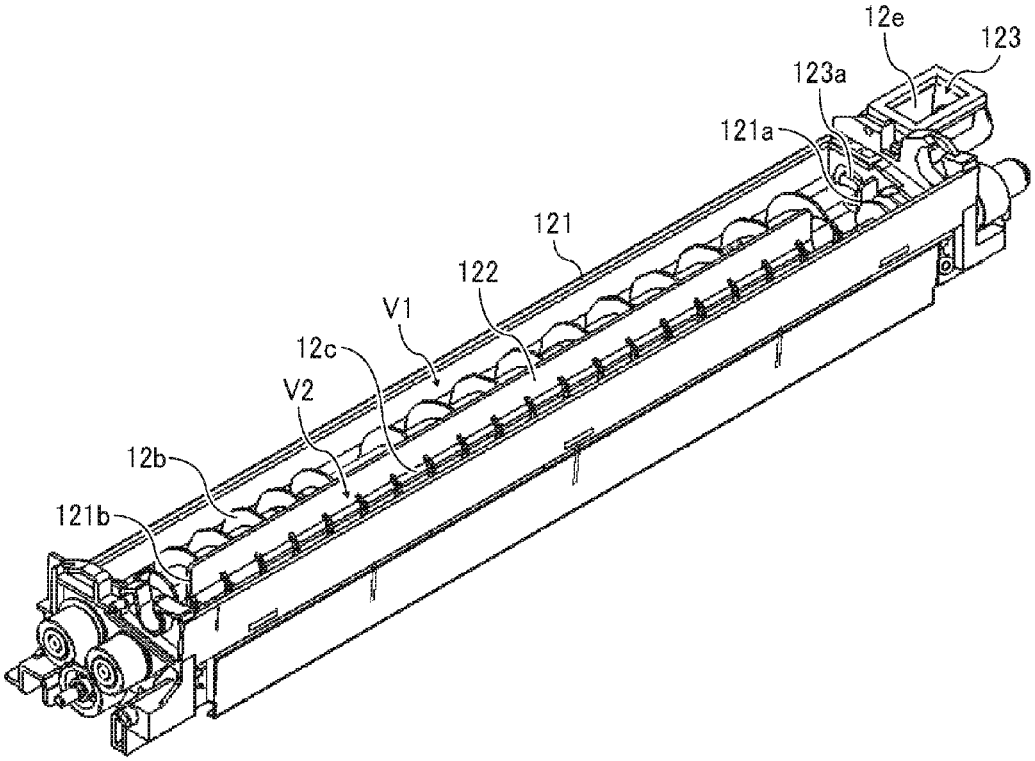
FIG. 4 is a perspective view of the developing device illustrated in FIG. 3, from which an upper casing and a developing roller are removed to illustrate an interior of a developer containing compartment.

FIG. 4 is a perspective view of the developing device 12 from which an upper casing and the developing roller 12*a* are removed, to illustrate an interior of the developer containing compartment.

Figure 5:
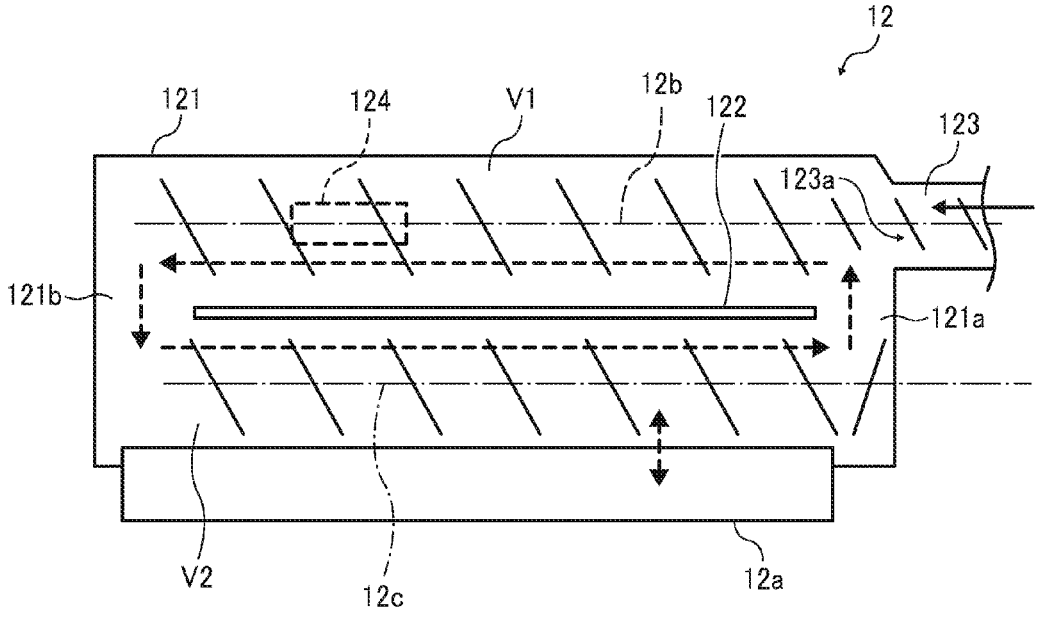
FIG. 5 is a schematic diagram illustrating a circulation passage of developer in the developing device illustrated in FIG. 4.

FIG. 5 is a schematic diagram illustrating a circulation passage of the developer in the developing device 12. In FIG. 5, broken line arrows represent the flow of the developer, and solid line arrows represent the flow of the toner supplied from a toner supply inlet 12*e* (see FIG. 4) located on the upstream side of the first conveying screw 12*b* in the direction in which the first conveying screw 12*b* conveys the developer.

A casing 121 illustrated in FIG. 4 defines the developer containing compartment inside the developing device 12. The developer containing compartment is divided, with a partition 122, into the first developer compartment V1 and the second developer compartment V2. The first and second conveying screws 12*b* and 12*c* are disposed in the first and second developer compartments V1 and V2, respectively. The first developer compartment V1 communicates with the first developer compartment V1 through openings 121*a* and 121*b* located at ends of the partition 122.

At the downstream end of the second developer compartment V2 in the direction in which the second conveying screw 12*c* transports the developer, the developer moves to the first developer compartment V1, through the opening 121*a* at the end of the partition 122. Inside the first developer compartment V1, while stirring the developer, the first conveying screw 12*b* transports the developer in the direction opposite the direction in which the developer moves inside the second developer compartment V2. At the downstream end of the first developer compartment V1 in the direction in which the first conveying screw 12*b* transports the developer, the developer moves through the opening 121*b* to the second developer compartment V2. Thus, the first and second conveying screws 12*b* and 12*c* disposed in the first and second developer compartments V1 and V2, respectively, circulate the developer inside the developer containing compartment partitioned by the partition 122.

The upstream end of the first developer compartment V1 in the developer conveyance direction communicates with a toner supply passage 123. The toner supply inlet 12*e* is disposed in the toner supply passage 123. Through the toner supply inlet 12*e*, fresh toner and the toner collected by the cleaning device 14 are supplied. The first conveying screw 12*b* disposed in the first developer compartment V1 extends into the toner supply passage 123. The first developer compartment V1 communicates with the toner supply passage 123 through a communication opening 123*a*. The toner supplied from the toner supply inlet 12*e* is transported by the spiral blade 12*b* 4 (illustrated in FIG. 19) of the first conveying screw 12*b* inside the toner supply passage 123 and transported to the first developer compartment V1 through the communication opening 123*a*. The toner concentration sensor 124 (illustrated in FIG. 5) to detect the toner concentration of the developer is disposed below the first developer compartment V1 of the casing 121.

Descriptions are given of a mechanism for toner recycle with reference to FIGS. 6 to 10.

Figure 6:
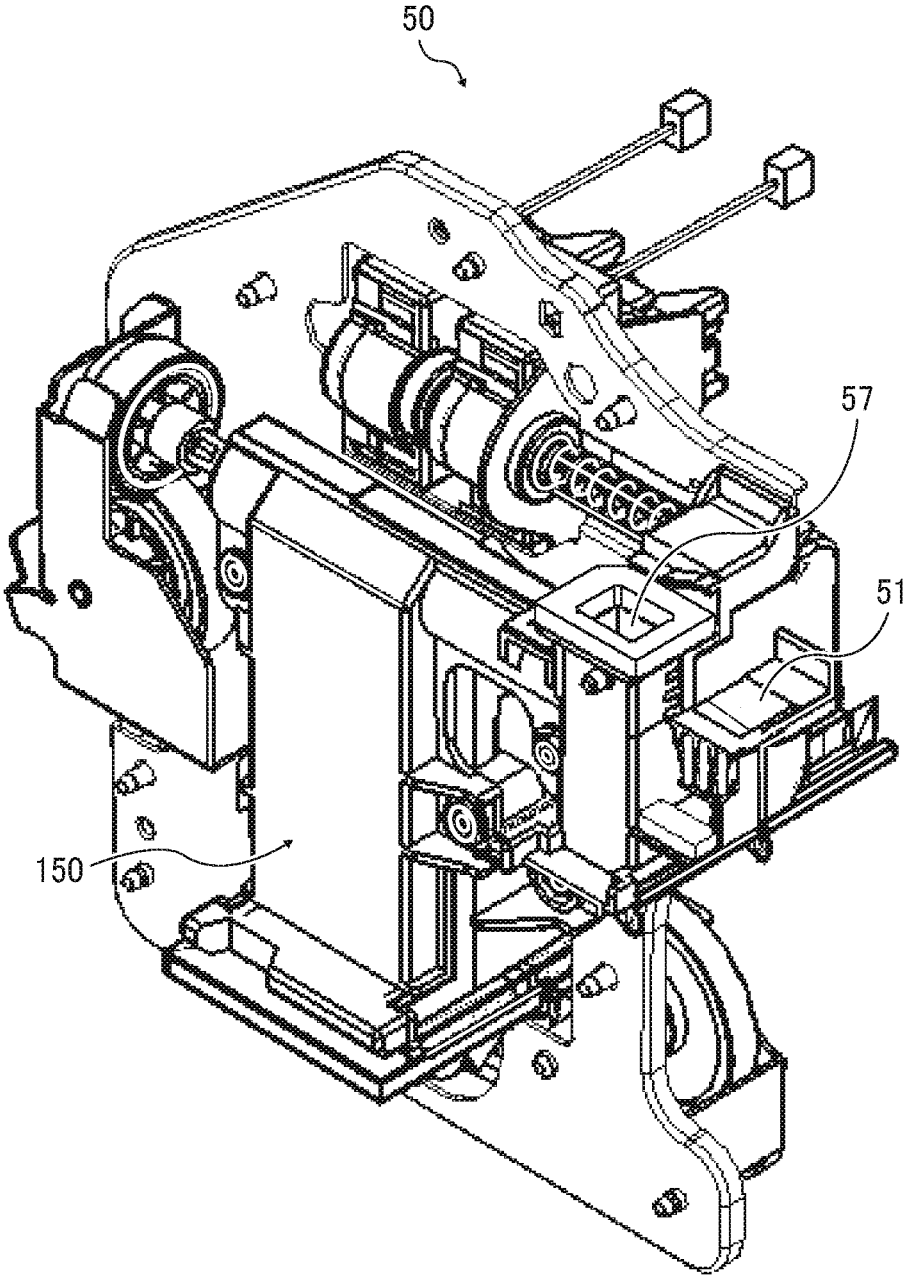
FIG. 6 is a perspective view of a toner conveyance device to which the process cartridge illustrated in FIG. 2A is coupled.
Figure 7:
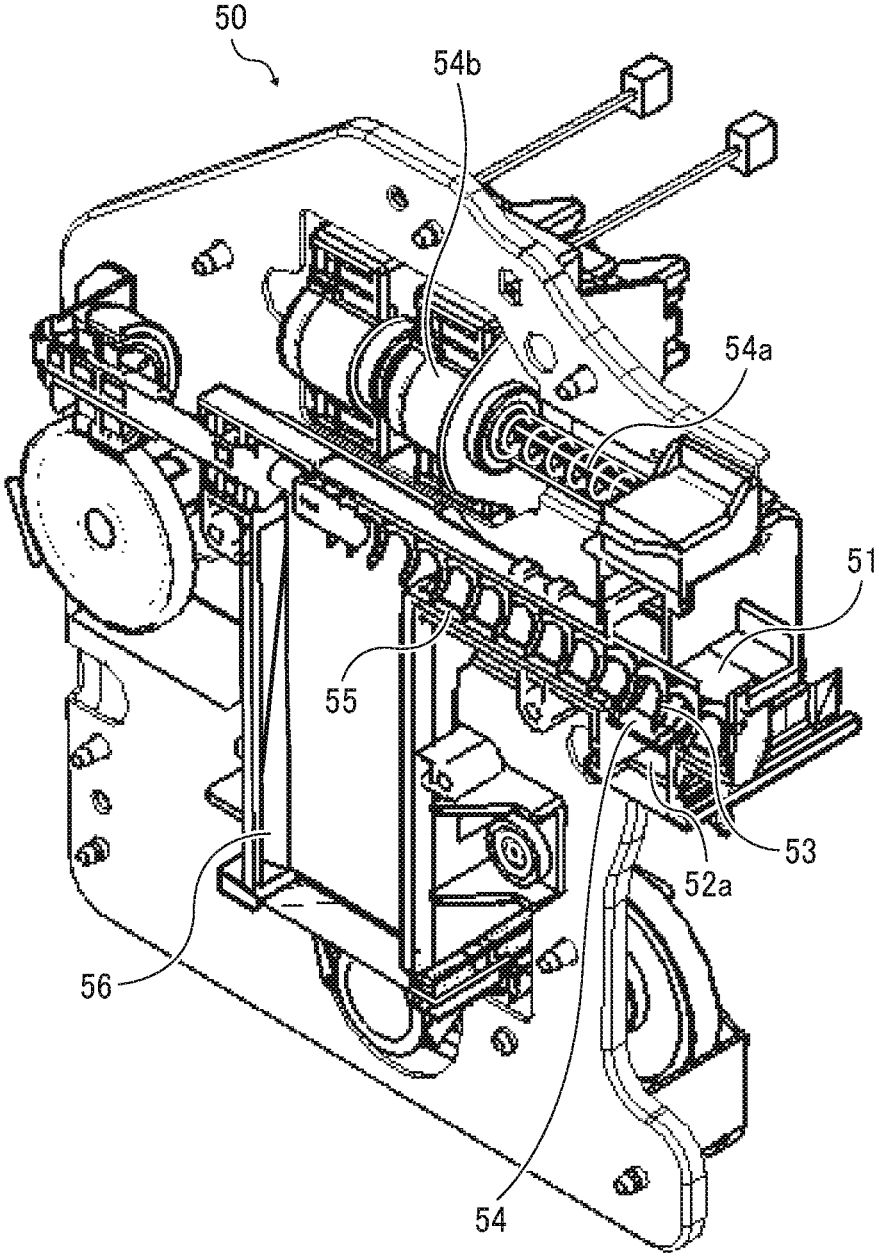
FIG. 7 is a perspective view of the toner conveyance device illustrated in FIG. 6.
Figure 8:
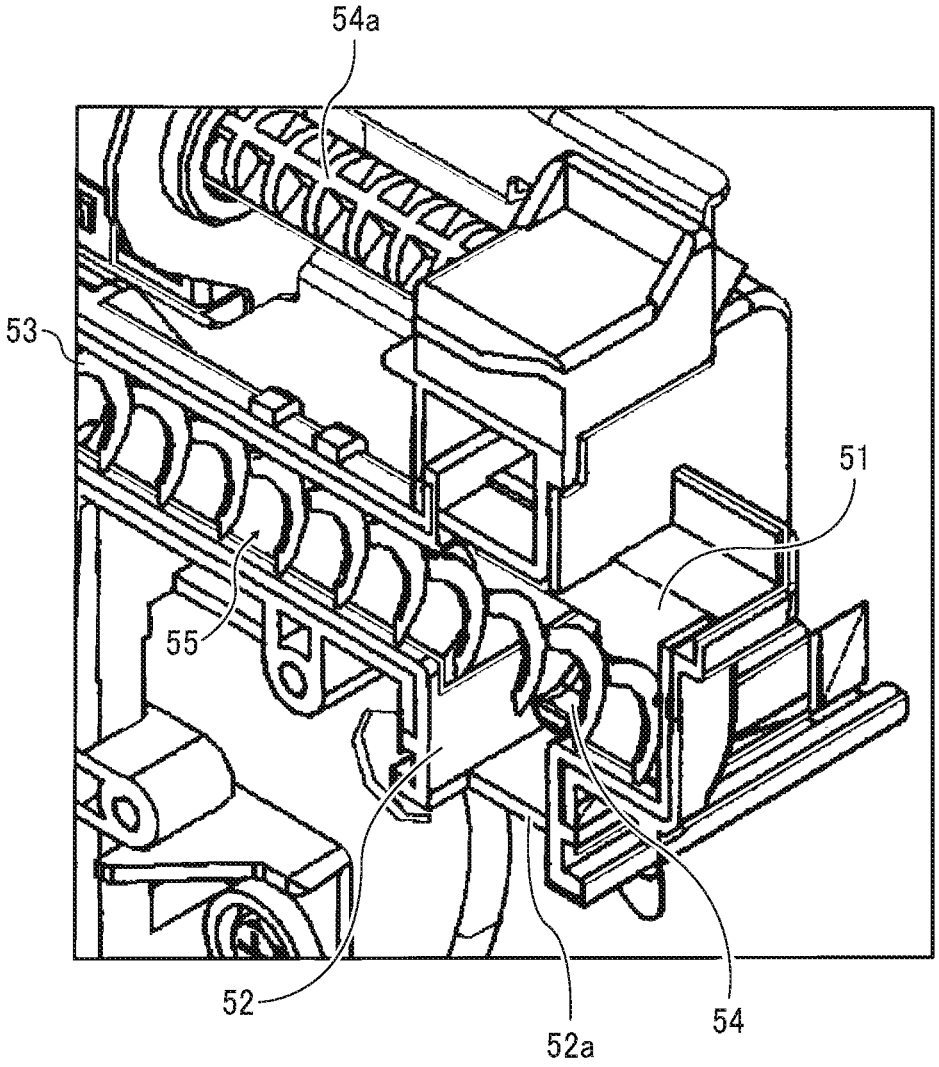
FIG. 8 is a perspective view of the toner conveyance device.
Figure 9:
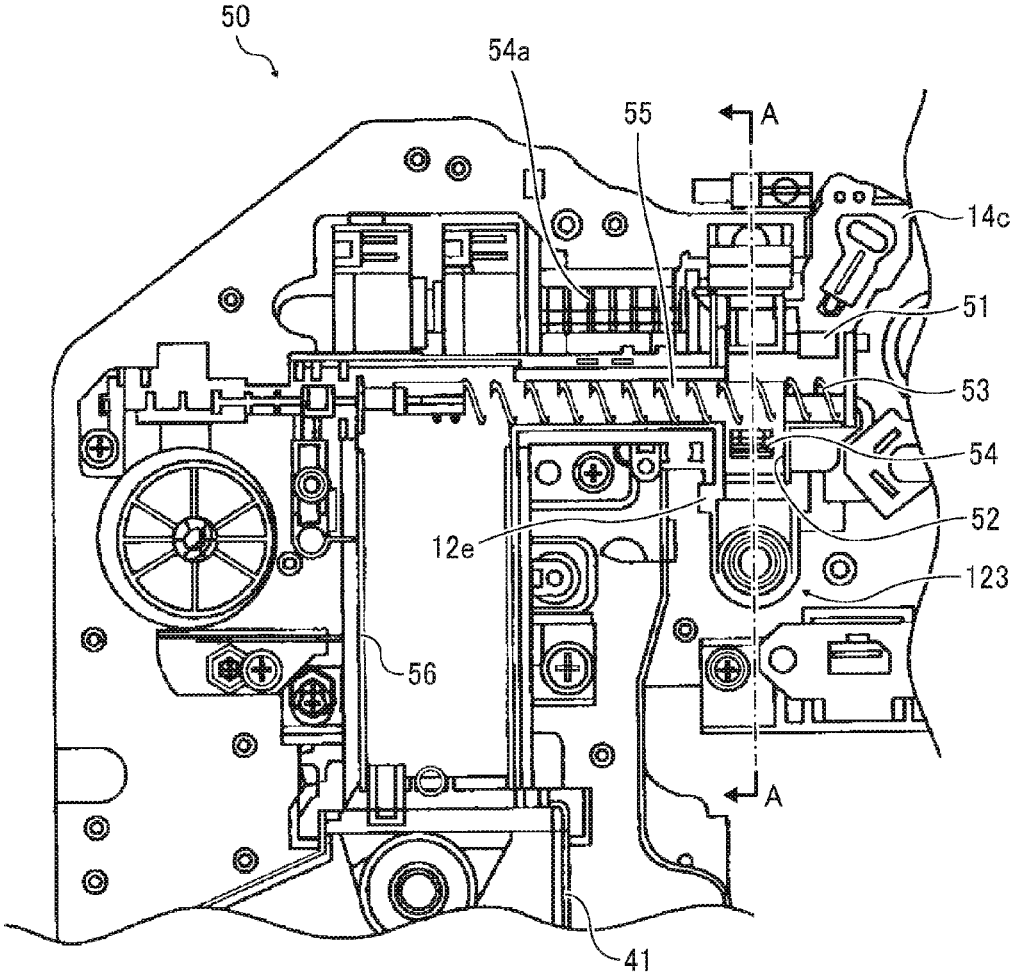
FIG. 9 is a cross-sectional view of the toner conveyance device.
Figure 10:
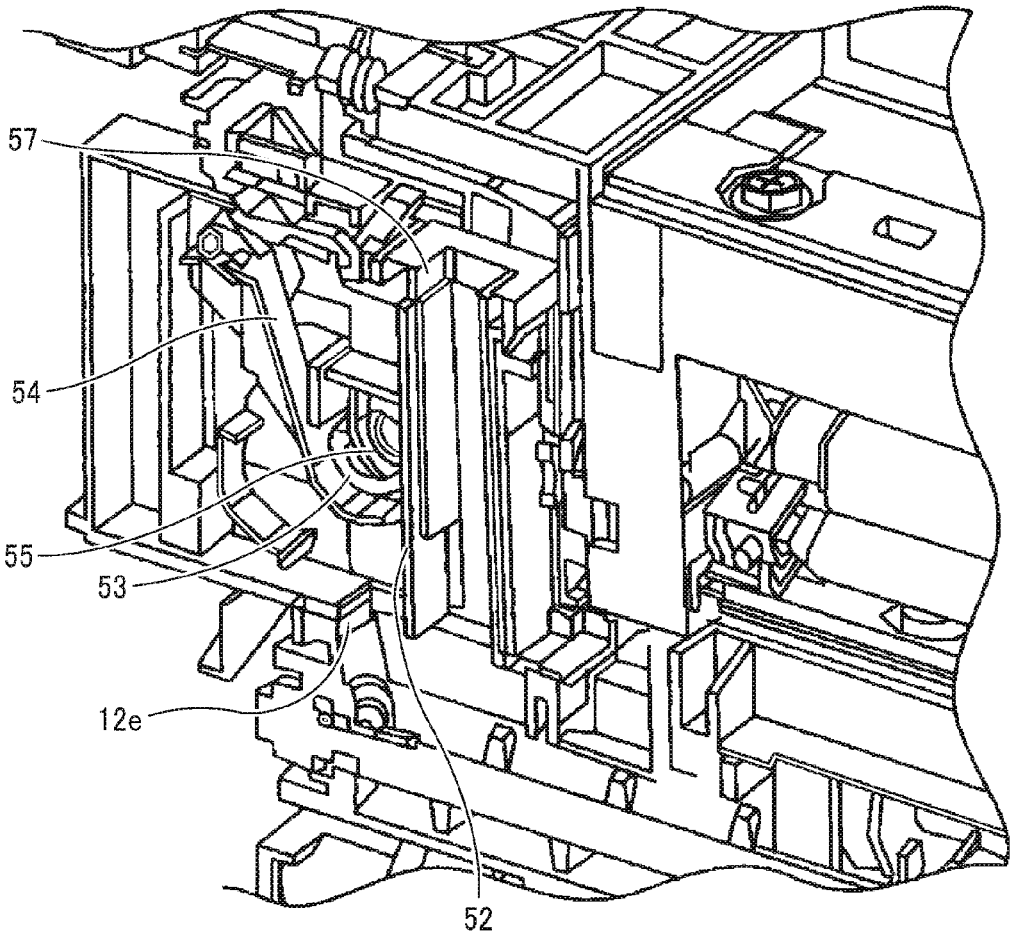
FIG. 10 is a cross-sectional view of the toner conveyance device, taken along a line A-A in FIG. 9.

FIG. 6 is a perspective view illustrating the toner conveyance device 50. FIG. 7 is a perspective view of a portion of the toner conveyance device 50. FIG. 8 is an enlarged perspective view illustrating a main portion of the toner conveyance device 50. FIG. 9 is a cross-sectional view of the toner conveyance device 50. FIG. 10 is a cross-sectional view along line A-A illustrated in FIG. 9.

The toner conveyance device 50 illustrated in FIG. 6 is disposed in the apparatus body 100, and the process cartridge 1 is coupled to the toner conveyance device 50. The toner conveyance device 50, serving as a toner supply device, includes a collected-toner conveyance section 150 to transport the toner collected from the cleaning device 14 (illustrated in FIG. 2B) to either the developing device 12 or the waste-toner container 41 (illustrated in FIG. 1). The collected-toner conveyance section 150 has a collected-toner inlet 51 to receive the collected toner from the cleaning device 14. As illustrated in FIG. 7, the collected-toner inlet 51 communicates with the upstream end of a collected-toner passage 55 in the direction in which the collected toner is conveyed. Inside the collected-toner passage 55, a conveying coil 53 is disposed to convey the collected toner. The downstream end of the collected-toner passage 55 in the conveyance direction therein is coupled to a waste-toner passage 56, through which the collected toner falls toward the waste-toner container 41 illustrated in FIG. 1.

Further, as illustrated in FIG. 8, at a position downstream from the connection with the collected-toner inlet 51, the collected-toner passage 55 branches to a collected-toner supply passage 52 to supply the collected toner to the developing device 12. The collected-toner conveyance section 150 includes a shutter 54 to connect and shut off the collected-toner passage 55 to and from the collected-toner supply passage 52. The shutter 54 serves as a passage selector. The shutter 54 is attached to a first end of a drive shaft 54*a*, and the other end (a second end) of the drive shaft 54*a* is coupled to a motor 54*b* for opening and closing the shutter 54 (see FIG. 15B, serving as an open-close motor). The shutter 54 is opened and closed to select the destination of the collected toner from a route leading to the waste-toner container 41 on the downstream side of the collected-toner passage 55 and a route leading to the developing device 12 below the collected-toner supply passage 52.

As illustrated in FIGS. 6 and 10, the toner conveyance device 50 includes a fresh-toner passage 57. Via the fresh-toner passage 57, a toner conveyance passage to convey the fresh toner from the toner bottle 20 (in FIG. 1) communicates with the toner supply inlet 12*e* of the developing device 12.

Figure 11:
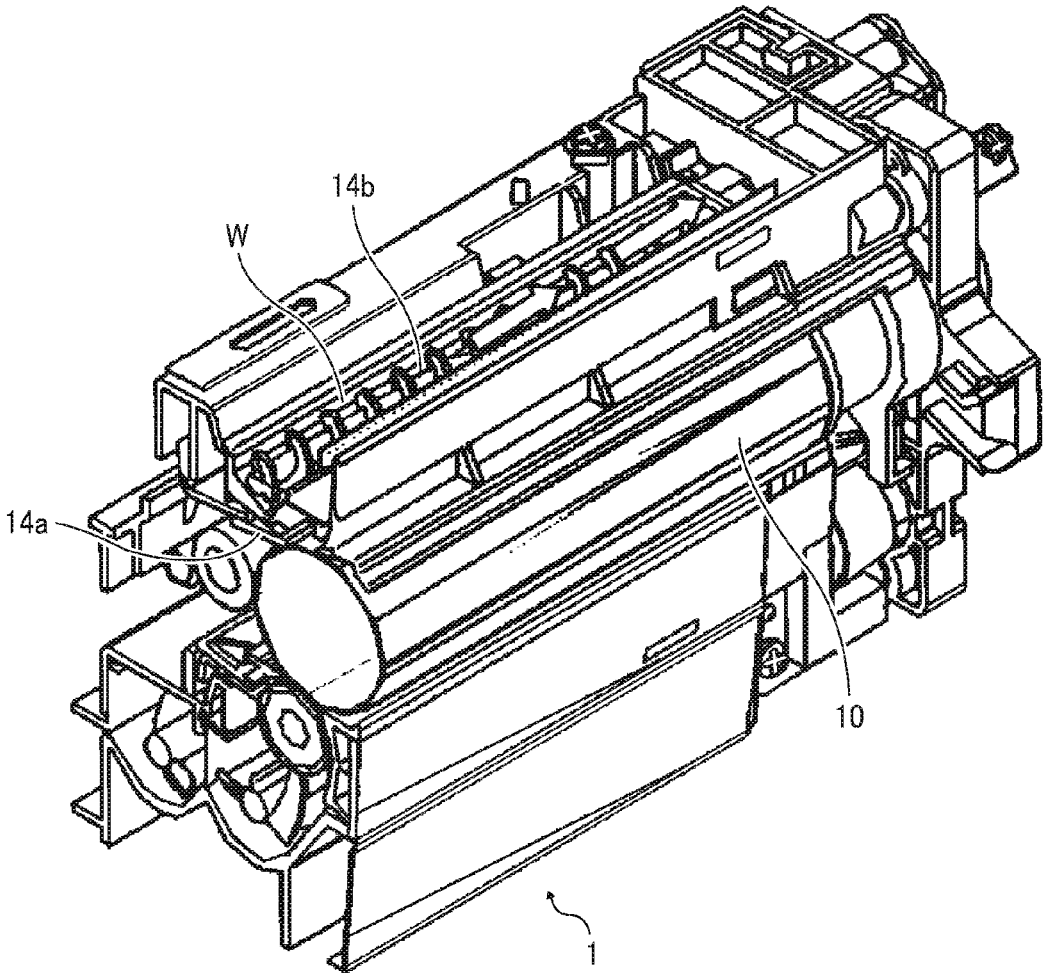
FIG. 11 is a perspective view of the process cartridge illustrated in FIG. 2A.

FIG. 11 is a perspective view of the process cartridge 1 removed from the image forming apparatus 500.

The cleaning blade 14*a* dams the residual toner remaining on the photoconductor 10 and removes the residual toner therefrom. The residual toner dammed up by the cleaning blade 14*a* is pushed by the subsequent toner on the photoconductor 10, and the dammed toner moves to the upper side of the cleaning blade 14*a*. The residual toner is further pushed to the collected toner compartment W and collected therein. In the collected toner compartment W, the toner collecting coil 14*b* conveys the collected toner toward the back end (one end in the axial direction) of the process cartridge 1.

Figure 12:
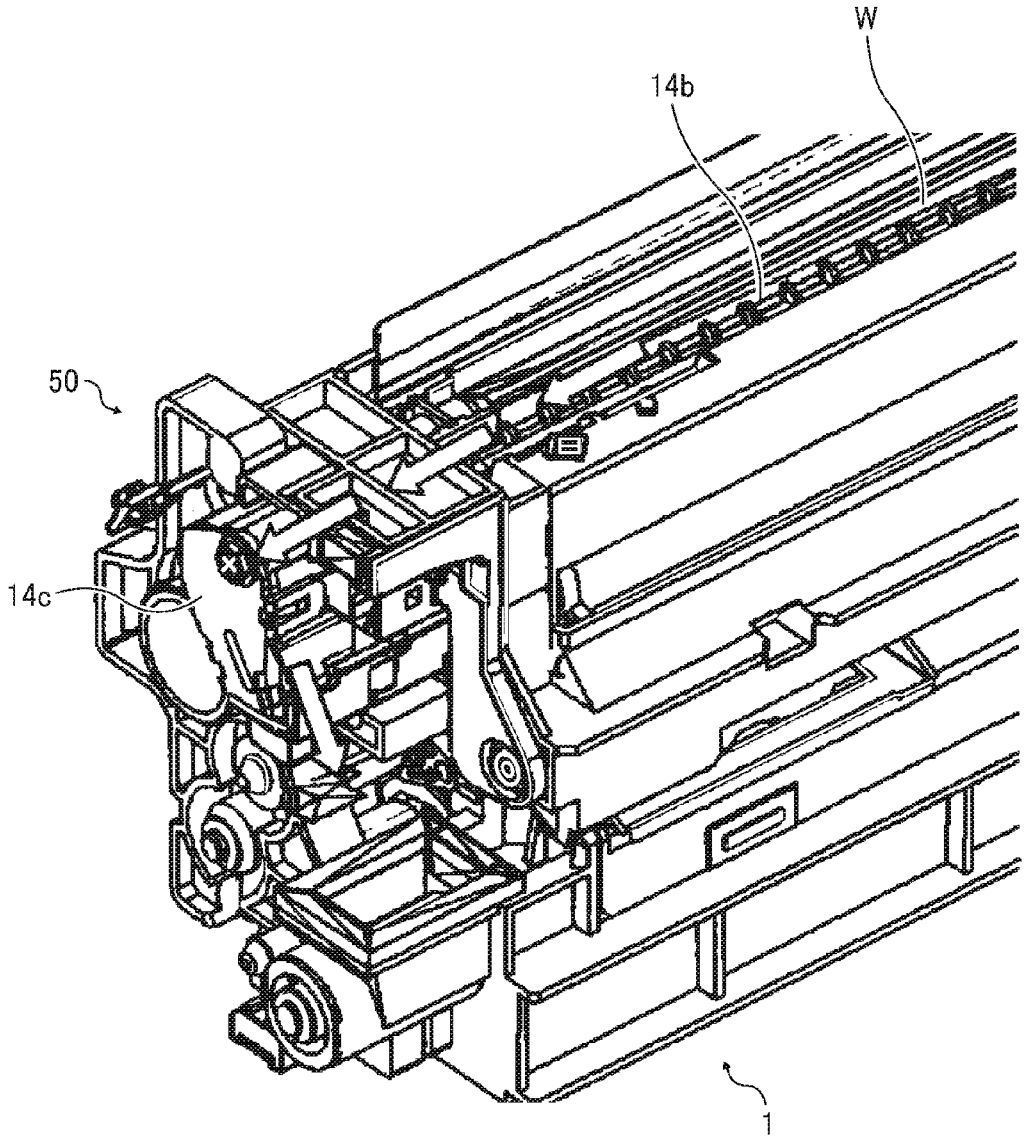
FIG. 12 is a perspective view of a back side of the process cartridge illustrated in FIG. 11.

FIG. 12 is a perspective view of the back side of the process cartridge 1 illustrated in FIG. 11. As illustrated in FIG. 12, a connecting portion 14*c* for connecting the conveyance of collected toner is disposed on the back side face of the process cartridge 1. The connecting portion 14*c* connects the collected toner compartment W and the collected-toner inlet 51 of the toner conveyance device 50 in the apparatus body 100 when the process cartridge 1 is mounted in the apparatus body 100. The collected toner conveyed by the toner collecting coil 14*b* to the back side end of the process cartridge 1 is received by the connecting portion 14*c*. The collected toner falls inside the connecting portion 14*c* to the collected-toner inlet 51 of the toner conveyance device 50.

Figure 13:
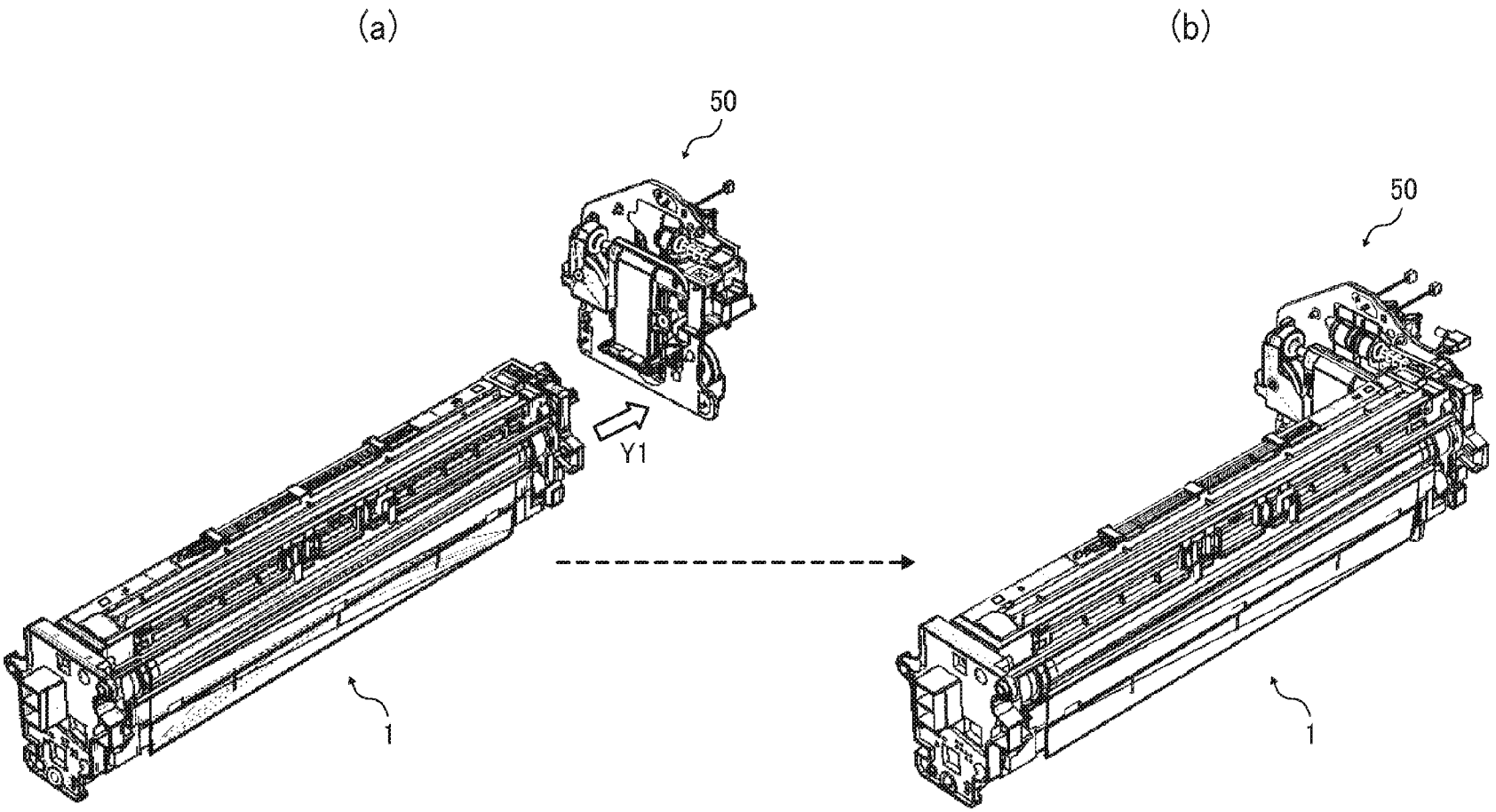
FIG. 13 is a perspective view illustrating the process cartridge being mounted in an apparatus body of the image forming apparatus illustrated in FIG. 1.

FIG. 13 is a perspective view illustrating the process cartridge 1 being mounted in the toner conveyance device 50 in the apparatus body 100.

As illustrated in FIG. 13, the toner conveyance device 50 is attached to a side plate of the apparatus body 100 on the back side in the direction indicated by arrow Y1 in (a) FIG. 13, in which the process cartridge 1 is mounted in the apparatus body 100. As the process cartridge 1 is mounted in the apparatus body 100 as illustrated in (b) in FIG. 13, as illustrated in FIG. 9, the connecting portion 14*c* is coupled to the collected-toner inlet 51 of the toner conveyance device 50 in the apparatus body 100. Additionally, as illustrated in FIG. 10, the toner supply inlet 12*e* of the developing device 12 is coupled to the fresh-toner passage 57 of the toner conveyance device 50. The toner supply inlet 12*e* is also coupled to the collected-toner supply passage 52. In other words, the collected-toner supply passage 52 is coupled to the fresh-toner passage 57.

Figure 14:
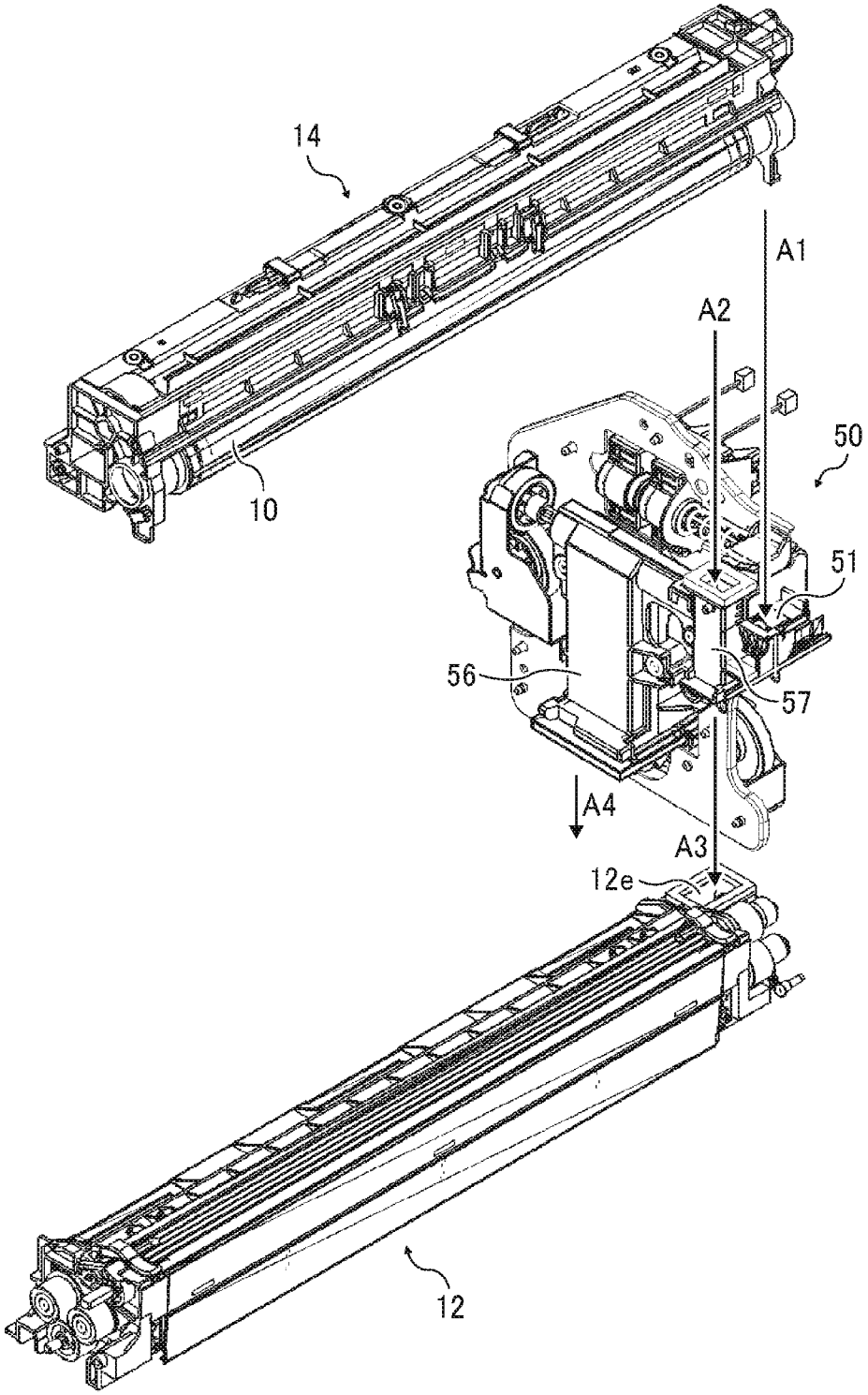
FIG. 14 is a perspective view of the process cartridge and the toner conveyance device.

With reference to FIG. 14, descriptions are given below of conveyance of the fresh toner and the collected toner performed by the toner conveyance device 50. FIG. 14 is a perspective exploded view of the toner conveyance device 50, the cleaning device 14, and the developing device 12.

When the value measured (detected) by the toner concentration sensor 124 illustrated in FIG. 5 exceeds the target value (the threshold), that is, when the toner concentration in the developing device 12 is reduced, the toner conveyance device 50 supplies the toner from the toner bottle 20 illustrated in FIG. 1 to the fresh-toner passage 57 as indicated by arrow A2 in FIG. 14. The toner falls inside the fresh-toner passage 57 and is supplied through the toner supply inlet 12*e* into the developing device 12 as indicated by arrow A3.

The toner collected by the cleaning device 14 falls inside the connecting portion 14*c* (illustrated in FIG. 12) to the collected-toner inlet 51 of the toner conveyance device 50 as indicated by arrow A1. To reuse the collected toner, the shutter 54 (see FIG. 9) is opened to connect the collected-toner passage 55 to the collected-toner supply passage 52 coupled to the toner supply inlet 12*e*. As indicated by arrow A3 in FIG. 14, the toner is supplied through the toner supply inlet 12*e* into the developing device 12. By contrast, to discard the collected toner, the collected toner is conveyed through the collected-toner passage 55 (see FIG. 9) and the waste-toner passage 56. As indicated by arrow A4 in FIG.

14, the collected toner falls inside the waste-toner passage 56 to the waste-toner container 41 illustrated in FIG. 1.

Referring to FIGS. 15A through 16C, descriptions are given below of toner conveyance with movement of the shutter 54.

Figure 15A:
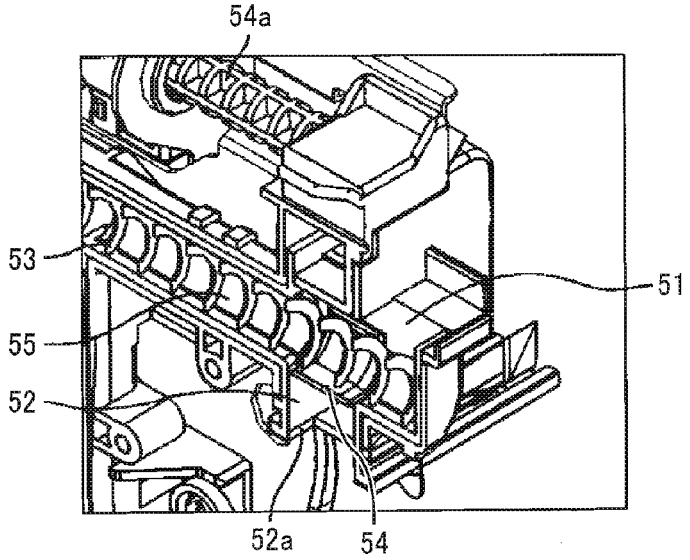
FIG. 15A is a perspective view around a collected-toner inlet of the toner conveyance device, in a state for conveying the collected toner to a waste-toner container in the image forming apparatus illustrated in FIG. 1.
Figure 15B:
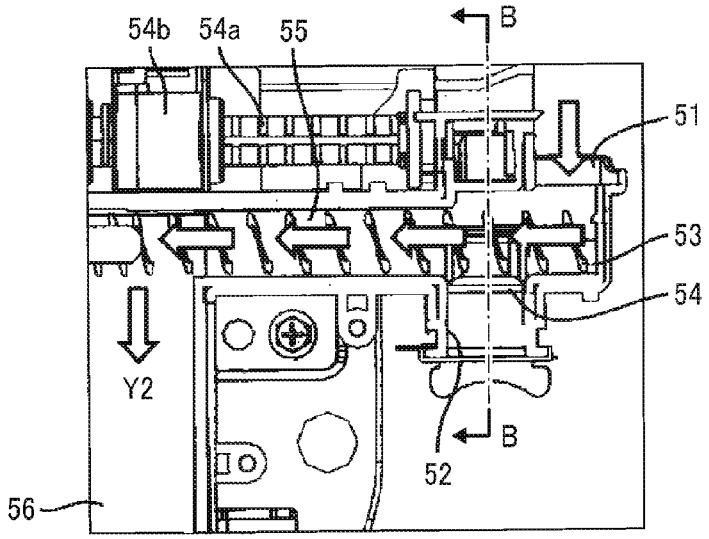
FIG. 15B is a cross-sectional view of a structure of the toner conveyance device for conveying the collected toner to the waste-toner container.
Figure 15C:
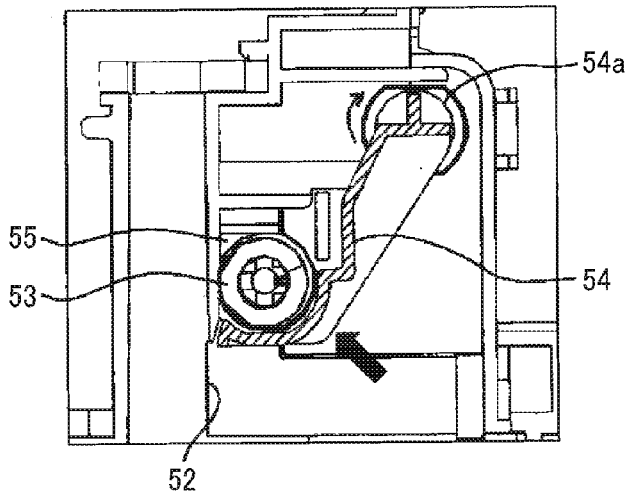
FIG. 15C is a cross-sectional view along line B-B in FIG. 15B.

FIG. 15A is a perspective view around the collected-toner inlet 51 of the toner conveyance device 50, in a state for conveying the collected toner to the waste-toner container 41. FIG. 15B is a cross-sectional view of a structure of the toner conveyance device 50 for conveying the collected toner to the waste-toner container 41. FIG. 15C is a cross-sectional view along line B-B in FIG. 15B.

To convey the collected toner to the waste-toner container 41, the motor 54*b* for opening and closing the shutter 54, illustrated in FIG. 15B, is driven to rotate the drive shaft 54*a* clockwise in FIG. 15C, for a predetermined angle. Then, the shutter 54 coupled to the first end of the drive shaft 54*a* rotates clockwise in FIG. 15C, for the predetermined angle, around an attachment portion of the drive shaft 54*a* to which the shutter 54 is attached. As illustrated in FIGS. 15A and 15C, the shutter 54 closes the connection between the collected-toner passage 55 and the collected-toner supply passage 52. Accordingly, in this case, the collected toner supplied from the connecting portion 14*c* (see FIG. 12) to the collected-toner inlet 51 (see FIG. 15B) is conveyed by the conveying coil 53 inside the collected-toner passage 55. At the downstream end of the collected-toner passage 55 in the toner conveyance direction therein, the collected toner falls, as indicated by arrow Y2, through the waste-toner passage 56 to the waste-toner container 41.

Descriptions are given below of conveyance of the collected toner to the developing device 12, with reference FIGS. 16A through 16C.

Figure 16A:
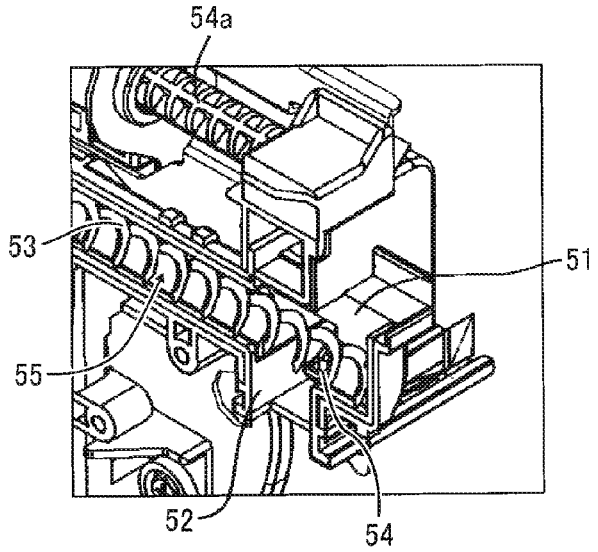
FIG. 16A is a perspective view around the collected-toner inlet of the toner conveyance device, in a state for conveying the collected toner to the developing device illustrated in FIG. 5.

FIG. 16A is a perspective view around the collected-toner inlet 51 of the toner conveyance device 50, in a state for conveying the collected toner to the developing device 12. FIG. 16B is a cross-sectional view of a structure of the toner conveyance device 50 for conveying the collected toner to the developing device 12. FIG. 16C is a cross-sectional view along line C-C in FIG. 16B.

Figure 16B:
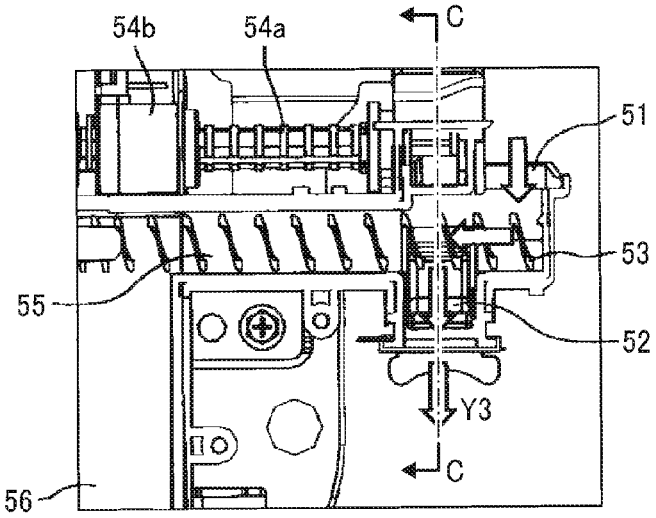
FIG. 16B is a cross-sectional view of a structure of the toner conveyance device for conveying the collected toner to the developing device.
Figure 16C:
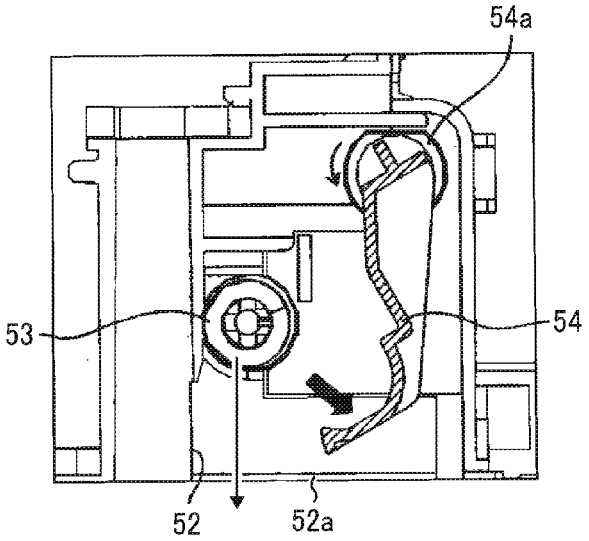
FIG. 16C is a cross-sectional view along line C-C in FIG. 16B.

To convey the collected toner to the developing device 12, the motor 54*b* for opening and closing the shutter 54, illustrated in FIG. 16B, is driven in the direction reverse to the direction for closing the shutter 54. Then, the drive shaft 54*a* is rotated counterclockwise in FIG. 16C for a predetermined angle. Then, the shutter 54 coupled to the first end of the drive shaft 54*a* rotates counterclockwise in FIG. 16C, for the predetermined angle, around the attachment portion of the drive shaft 54*a* to which the shutter 54 is attached. As illustrated in FIGS. 16A and 16C, the shutter 54 moves away from the connection between the collected-toner passage 55 and the collected-toner supply passage 52, allowing the connection between the collected-toner passage 55 and the collected-toner supply passage 52. With this structure, the collected toner supplied from the connecting portion 14*c* (see FIG. 12) to the collected-toner inlet 51 is conveyed by the conveying coil 53 but falls as indicated by arrow Y3, at a position midway toward the waste-toner passage 56, to the collected-toner supply passage 52. Then, the collected toner is supplied to the developing device 12, through the toner supply inlet 12*e* thereof.

Figure 17:
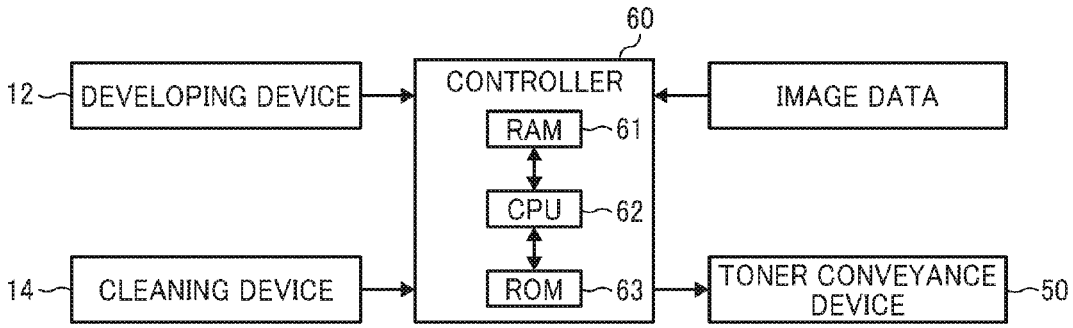
FIG. 17 is a block diagram illustrating electric circuitry of the image forming apparatus illustrated in FIG. 1.

FIG. 17 is a block diagram illustrating electrical circuitry of the image forming apparatus 500 according to the present embodiment. In FIG. 17, a controller 60 includes a central processing unit (CPU) 62 serving as a computing unit and memory devices such as a random access memory (RAM) 61 and a read only memory (ROM) 63. The controller 60 governs control of the entire image forming apparatus 500. Although major devices and major sensors used in control of conveyance of collected toner are illustrated in FIG. 17, various devices and sensor are connected to the controller 60.

The controller 60 controls the various devices according to control programs stored in the RAM 61 and the ROM 63. The controller 60 calculates the image area rate based on image data. Further, based on the calculated image area rate, the controller 60 controls opening and closing of the shutter 54.

Figure 18:
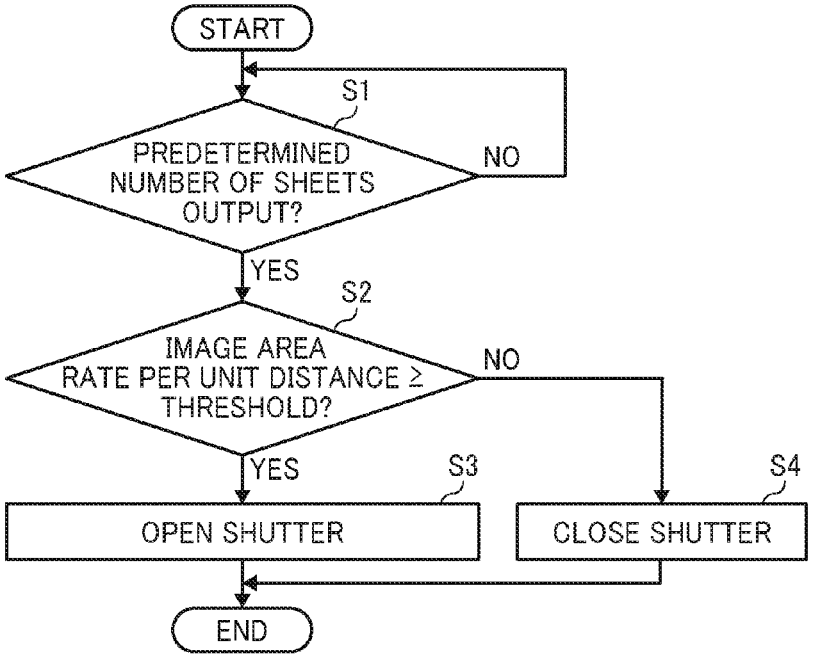
FIG. 18 is a flowchart of control of opening and closing a shutter in the toner conveyance device illustrated in FIGS. 6 through 10.

FIG. 18 is a flowchart that illustrates control of opening and closing of the shutter 54.

Referring to FIG. 18, the controller 60 counts the number of output sheets, the accumulated print area of output images, and the running distance of the developing device 12 (e.g., the developing roller 12*a* ). When a predetermined number of sheets are output, that is, the number of output sheets reaches the predetermined number (Yes at S1), the controller 60 calculates the image area rate per unit distance (i.e., unit running distance of the developing device 12) based on the accumulated print area of the output images and the running distance of the developing roller 12*a*. At S2, the controller 60 determines whether the image area rate per unit distance is equal to or greater than the threshold. In the present embodiment, the threshold is 3%, for example.

The predetermined number of sheets represents the number of sheets output in an estimated time for the toner collected by the cleaning blade 14*a* to reach the branching point in the collected-toner passage 55 branching into the route leading to the waste-toner container 41 and the route leading to the developing device 12. In other words, while the image forming operation is performed for outputting the predetermined number of sheets, the toner collected by the cleaning blade 14*a* during printing on the first page reaches the branching point. In the present embodiment, as illustrated in FIG. 2B, the collected toner compartment W is located above or at a position higher than the position where the cleaning blade 14*a* abuts against the photoconductor 10. Accordingly, as described above, the residual toner removed by the cleaning blade 14*a* is not directly guided to the collected toner compartment W but is kept dammed by the cleaning blade 14*a*. The residual toner is gradually pushed up by the subsequent toner and is collected in the collected toner compartment W. Thus, for the collected toner to reach the branching point in the collected-toner passage 55 branching into the route leading to the waste-toner container 41 and the route leading to the developing device 12, it takes time equivalent to time for outputting the predetermined number of sheets.

As the image area rate decreases, the area of contact between the photoconductor 10 and the sheet S increases, and the possibility of adhesion of dust (e.g., paper dust) to the photoconductor 10 increases. Accordingly, when the image area rate per unit distance is smaller than the threshold (No at S2), it is a condition under which the amount of dust mixed in the collected toner is large. In this case, at S4, the shutter 54 is closed to convey the collected toner to the waste-toner container 41, and the collected toner is discarded. This is a condition under which the toner collected during printing on the predetermined number of sheets includes a large amount of dust, and the collected toner is conveyed to the waste-toner container 41 and discarded.

By contrast, when the image area rate per unit distance is equal to or greater than the threshold (Yes at S2), it is a condition under which the toner collected during printing on the predetermined number of sheets includes a small amount of dust. In this case, at S3, the shutter 54 is opened to supply the collected toner to the developing device 12 for reuse.

Although, in the above-described example, opening and closing the shutter 54 is controlled based on the image area rate per unit running distance of the developing device 12, the parameter for controlling opening and closing the shutter 54 is not limited thereto. For example, image area rate per page may be used instead. Specifically, when a predetermined number of sheets are output, the controller 60 calculates the image area rate per page based on the accumulated print area of images and the number of pages. The controller 60 controls opening and closing the shutter 54 based on the calculated image area rate per page. In the case of the image area rate per page, similarly, when the amount of dust mixed in the collected toner is large, the collected toner is conveyed to the waste-toner container 41. When the amount of dust mixed in the collected toner is small, the collected toner is conveyed to the developing device 12.

Next, a distinctive feature of the present embodiment is described below.

Inside the process cartridge 1 illustrated in FIGS. 2A and 2B, as the photoconductor 10 or the developing roller 12*a* of the developing device 12 rotates, air flows into the developing device 12. Thus, airflow is generated. With the airflow, the pressure inside the developing device 12 rises. As the pressure inside the developing device 12 rises, the internal pressure rise is transmitted, via the communication opening 123*a* and the toner supply passage 123 illustrated in FIG. 5, to the collected-toner passage 55 (see FIG. 9) and the fresh-toner passage 57 (see FIG. 10) of the toner conveyance device 50 illustrated in FIG. 4. Such an internal pressure rise is further transmitted to the waste-toner container 41 via the collected-toner passage 55 and to the toner bottle 20 via the fresh-toner passage 57. When the internal pressure of the collected-toner passage 55 or the internal pressure of the waste-toner container 41 rises, air may leak from the connection with the toner conveyance device 50. Specifically, air may leak from the connection between the toner supply inlet 12*e* and the collected-toner supply passage 52, the connection between the waste-toner container 41 and the waste-toner passage 56, and the connection between the collected-toner inlet 51 and the connecting portion 14*c*. Similarly, air may leak from the connection between the toner supply inlet 12*e* and the fresh-toner passage 57 and the connection between the fresh-toner passage 57 and the toner conveyance passage leading to the toner bottle 20.

If air leaks from such connections, toner contained in the toner conveyance device 50 or the waste-toner container 41 may scatter out together with the leaking air, resulting in stains inside the image forming apparatus 500.

In view of the foregoing, in the present embodiment, the developing device 12 is designed to seal the communication opening 123*a* (i.e., opening on the side of the first developer compartment V1) with the developer contained inside the first developer compartment V1 to inhibit transmission of the internal pressure rise of the developing device 12 to the toner conveyance device 50. Features of the present embodiment are described in further detail below.

Figure 19:
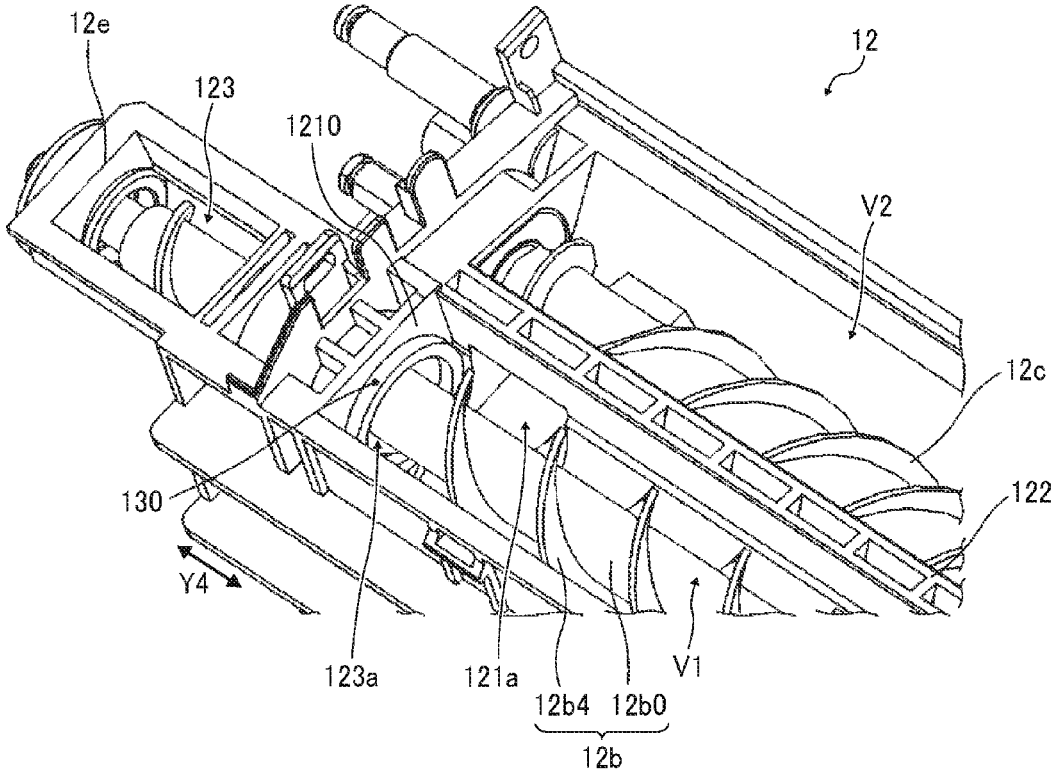
FIG. 19 is a perspective view of an end portion of the developing device illustrated in FIG. 5.
Figure 20:
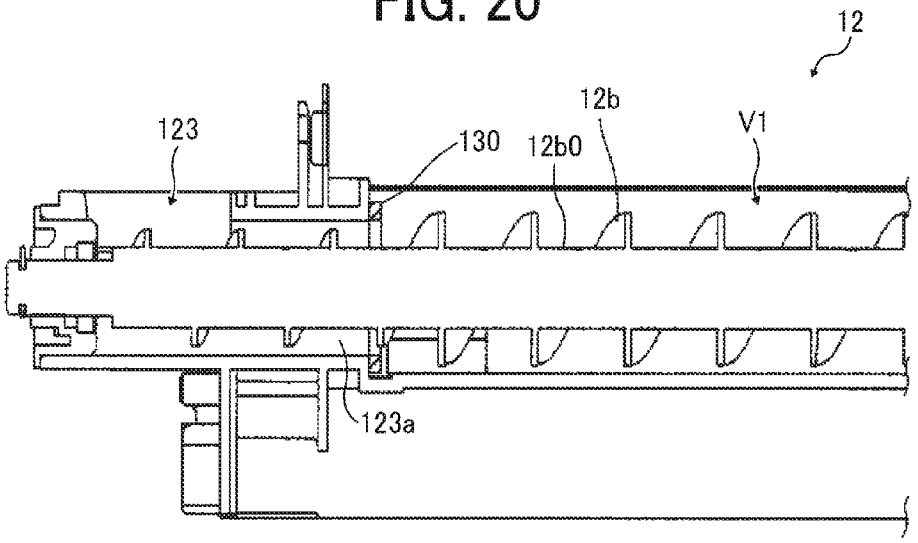
FIG. 20 is a cross-sectional view of the end portion of the developing device illustrated in FIG. 19.
Figure 21A:
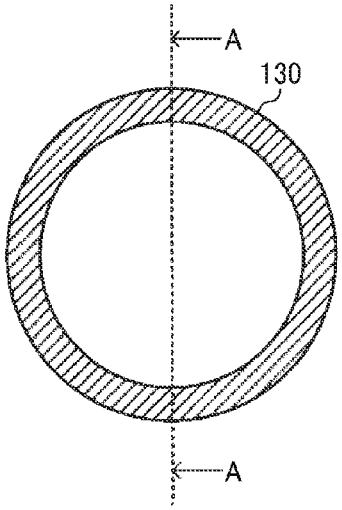
FIG. 21A is a side view of a cylindrical magnet disposed in the end portion of the developing device illustrated in FIGS. 19 and 20, as viewed from the right or left in FIG. 20.
Figure 21B:
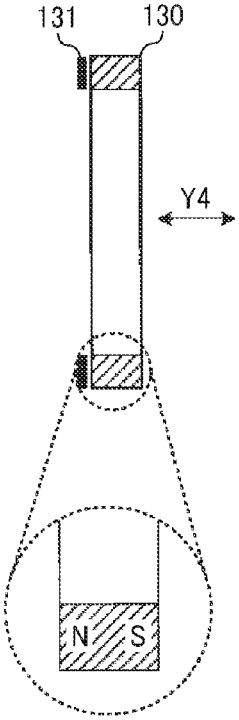
FIG. 21B is a cross-sectional view of the cylindrical magnet along line A-A in FIG. 21A.
Figure 21C:
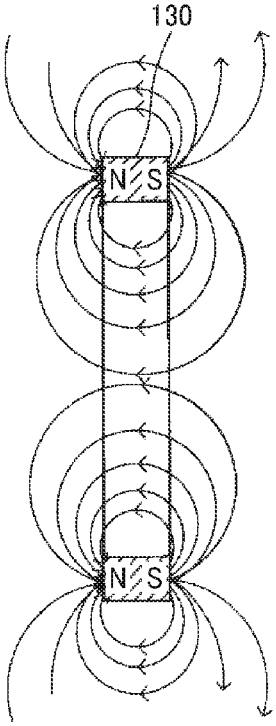
FIG. 21C is a schematic diagram illustrating magnetic force lines of the cylindrical magnet; illustrated in FIG. 21A.

FIG. 19 is a perspective view of an end portion of the developing device 12. FIG. 20 is a cross-sectional view of the end portion of the developing device 12 illustrated in FIG. 19. FIGS. 21A through 21C are schematic diagrams of a cylindrical magnet 130 disposed in the end portion of the developing device 12. FIG. 21A is a side view of the cylindrical magnet 130, as viewed from the left or the right in FIG. 20. FIG. 21B is a cross-sectional view of the cylindrical magnet 130, along line A-A in FIG. 21A. FIG. 21C is a schematic diagram illustrating magnetic force lines of the cylindrical magnet 130.

As illustrated in FIGS. 19 and 20, the developing device 12 according to the present embodiment includes the cylindrical magnet 130. The cylindrical magnet 130 is attached to an inner wall face 1210 of the first developer compartment V1 (i.e., an inner wall of the casing 121 illustrated in FIG. 5) defining the communication opening 123*a* on the side of the first developer compartment V1. A shaft 12*b*0 of the first conveying screw 12*b* is inserted in the cylindrical magnet 130. That is, an arc-shaped inner face of the cylindrical magnet 130 surrounds the shaft 12*b*0 of the first conveying screw 12*b*. As illustrated in FIGS. 19 and 20, the cylindrical magnet 130 is ring-shaped when viewed in the axial direction of the first conveying screw 12*b*, indicated by arrow Y4. The shape of the cylindrical magnet 130 is not limited to annulus shapes such as a planar washer shape or a ring shape illustrated in the drawings but can be a square shape, a torus shape (like a donut or a floating ring), a polygonal shape in the cross section perpendicular to the axial direction indicated by arrow Y4. Referring to FIG. 21B, the magnetic poles of the cylindrical magnet 130 are arranged in the axial direction thereof (i.e., the longitudinal direction of the developing device 12). Such a magnetic pole arrangement is attained by magnetizing a non-magnetized mineral cylinder (or ring) in the axial direction, indicated by arrow Y4, of the cylinder (from one side to the other side in the axial direction). In the present embodiment, in a direction parallel to the axial direction of the cylinder, the south (S) pole is on the side of the cylindrical magnet 130 facing the first developer compartment V1, and the north (N) pole is on the opposite side facing the toner supply passage 123. The magnetic poles are arranged in the direction of thickness of the cylindrical magnet 130.

One of the planar faces of the cylindrical magnet 130 is attached to the inner wall face 1210 of the first developer compartment V1 defining the communication opening 123*a* via a double-sided adhesive tape 131 as illustrated in FIGS. 19 and 20. Specifically, the cylindrical magnet 130 is attached to the inner wall face 1210 such that the space enclosed by the arc-shaped inner face overlaps with the communication opening 123*a* (i.e., a hole in the casing wall) when viewed in the axial direction of the cylindrical magnet 130, indicated by arrow Y4, that is, on a cross section perpendicular to the axial direction thereof. Note that, in the case of torus shape, attachment can be secure when a portion of the torus is flattened to make a flat face to which the double-sided adhesive tape 131 is attached.

To seal the communication opening that connects an inside of the developing device with a toner conveyance passage outside the developing device, a bar-shaped magnet may be disposed adjacent to the communication opening. In this example, the communication opening is sealed with the magnetic ears of developer generated by the magnet. However, the magnetic force becomes weaker as the distance from the magnet increases. In a portion of the communication opening away from the magnet, sealing with the developer is weak and may be insufficient compared with a portion close to the magnet. Then, there is a risk that internal pressure rise of the developer containing compartment causes the toner to leak from the above-mentioned connections, allowing the toner to scatter.

By contrast, in the present embodiment, the cylindrical magnet 130 has the N pole on the side attached to the casing 121 and the S pole on the opposite side. Owing to this magnetic pole arrangement, as illustrated in FIG. 21C, the magnetic force lines curl into the cylindrical shape and concentrate on the inner side of the cylindrical magnet 130. As a result, compared with the comparative example in which the bar-shaped magnet is used to generate the magnetic field to seal the communication opening 123*a* with the magnetic ears, the communication opening 123*a* can be sealed with a sufficient amount of developer even when the magnetic force of the magnet is relatively weak. Accordingly, to generate a magnetic field having a magnetic flux density suitable to seal the communication opening 123*a*, a cylindrical magnet having a relatively weak magnetic force can be used.

If the magnetic force is too strong, the developer accumulates around the magnet and inhibits rotation of the first conveying screw 12*b*. Then, the magnetic force causes adverse effects. The conveyance of developer may become insufficient, the developer may flow in reverse to the second conveying screw 12*c*, or the developer may adhere again to the developing roller. In the present embodiment, a magnet having a relatively weak magnetic force can be used, which attains the following advantage. While the adverse effects of the magnet, caused on the periphery of the magnet, can be suppressed, the developer can fill in and seal the gap between the first conveying screw 12*b* and the inner wall face 1210 of the casing 121 around the first conveying screw 12*b*. Accordingly, this structure inhibits leak of air from the connections such as the connection between the toner conveyance device 50 and the waste-toner container 41 and that between the toner conveyance device 50 and the developing device 12. Note that the position of the cylindrical magnet 130 is not limited to the inner wall face 1210 of the first developer compartment V1 defining the communication opening 123*a* as long as the cylindrical magnet 130 is disposed such that the space enclosed by the arc-shaped inner face of the cylindrical magnet 130 overlaps with the communication opening 123*a* when viewed in the axial direction of the cylindrical magnet 130. For example, the cylindrical magnet 130 can be inserted in the hole penetrating the wall of the casing 121 or the inner wall face of the toner supply passage 123 defining the communication opening 123*a*.

In a case where the first conveying screw 12*b* has a relatively small shaft diameter, the developer attracted to and adhering to the inner face of the cylindrical magnet 130 does not reach the surface of the shaft 12*b*0 of the first conveying screw 12*b*. Then, the developer fails to seal the gap between the first conveying screw 12*b* and the inner wall face of the casing 121 around the first conveying screw 12*b*. An approach to eliminate such an inconvenience may be narrowing the gap between the inner wall face of the cylindrical magnet 130 and the shaft 12*b*0 of the first conveying screw 12*b*. However, the spiral blade 12*b* 4 of the first conveying screw 12*b* is shortened if the shaft diameter of the first conveying screw 12*b* is increased to narrow the gap. Then, the performance of conveying toner supplied from the toner supply inlet 12*e* is degraded around the cylindrical magnet 130, inviting the risk of clogging of the toner supply passage 123 with toner. Keeping the dimensional accuracy of the shaft diameter is difficult.

Therefore, in the structure illustrated in FIGS. 19 through 21C, the shaft 12*b*0 the first conveying screw 12*b* is made of a magnetic material, such as Steel Special Use Stainless (SUS) 416 according to Japan Industrial Standard (JIS). With this structure, a portion of the shaft 12*b*0 of the first conveying screw 12*b* facing the cylindrical magnet 130 is magnetized by the magnetic field, and the developer is attracted and adheres to the magnetized portion of the shaft 12*b*0 of the first conveying screw 12*b*. Compared with a case where the first conveying screw 12*b* has a shaft made of a nonmagnetic material, this structure attains the following advantage. The gap between the shaft 12*b*0 of the first conveying screw 12*b* and the cylindrical magnet 130 is filled with the developer even when the shaft 12*b*0 is relatively thin. Accordingly, the shaft 12*b*0 of the first conveying screw 12*b* can be kept thin to make the spiral blade 12*b* 4 relatively long in the direction extending from the shaft 12*b*0 to the contour (outer circumference) of the spiral blade 12*b* 4, and the degradation in the performance of conveying the supplied toner is inhibited.

Figure 22:
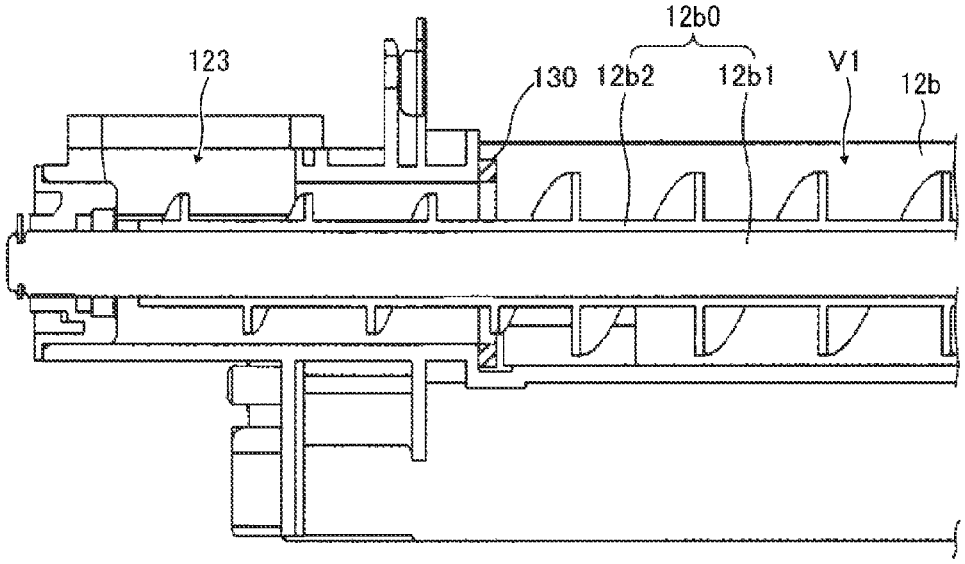
FIG. 22 is a cross-sectional view of a first conveying screw according to a variation.

Next, variations of the first conveying screw 12*b* are described. The cost of the first conveying screw 12*b* having a magnetic shaft increases as the shaft diameter increases. Accordingly, in a variation illustrated in FIG. 22, the shaft 12*b*0 of the first conveying screw 12*b* includes a magnetic shaft core 12*b*1 and a coating 12*b*2 covering the shaft core 12*b*1 by insert molding. The coating 12*b*2 is made of resin, for example. The diameter of the magnetic shaft core 12*b*1 is reduced to a degree capable of maintaining the magnetizing capability thereof. In this structure, the diameter of the relatively inexpensive shaft 12*b*0 having the thin shaft core 12*b*1 is adjustable by the thickness of the coating 12*b*2. This structure is advantageous over a magnetic shaft without a coating in that the gap between the shaft 12*b*0 of the first conveying screw 12*b* and the cylindrical magnet 130 is filled with the developer while reducing the diameter of the shaft 12*b*0 to keep the first conveying screw 12*b* inexpensive.

Figure 23:
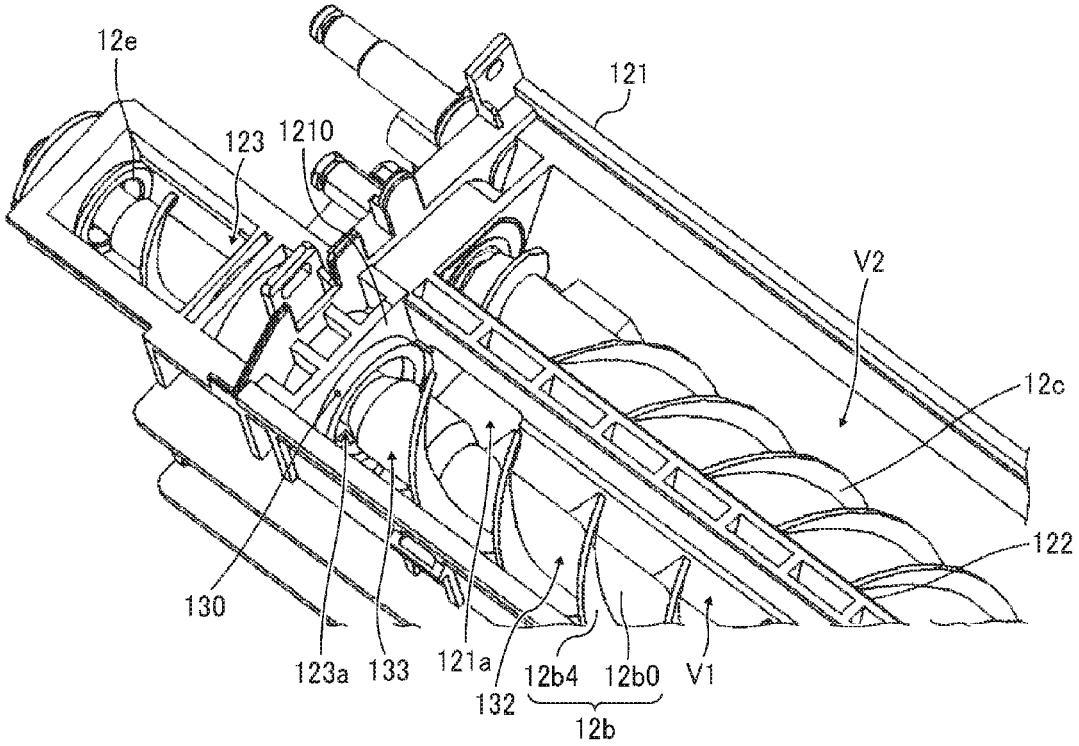
FIG. 23 is a perspective view of a developing device including a first conveying screw according to another variation.
Figure 24:
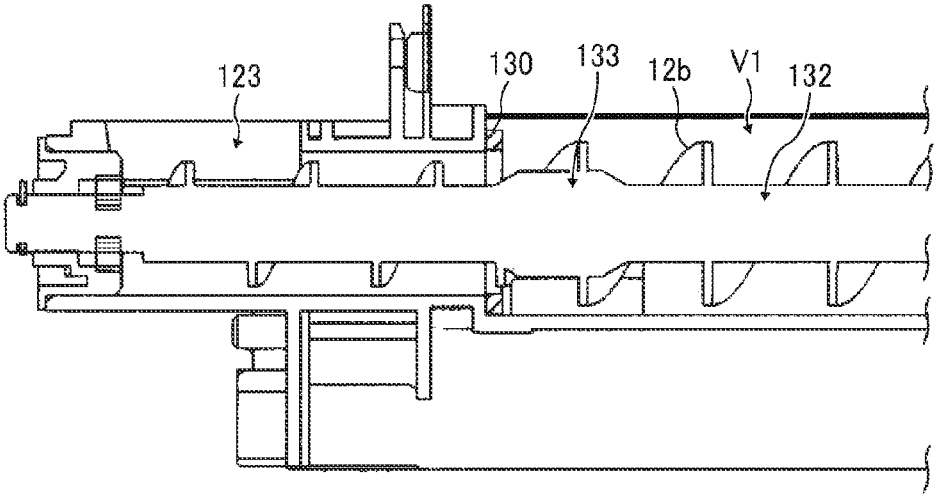
FIG. 24 is a side view of the first conveying screw illustrated in FIG. 3.
Figure 25:
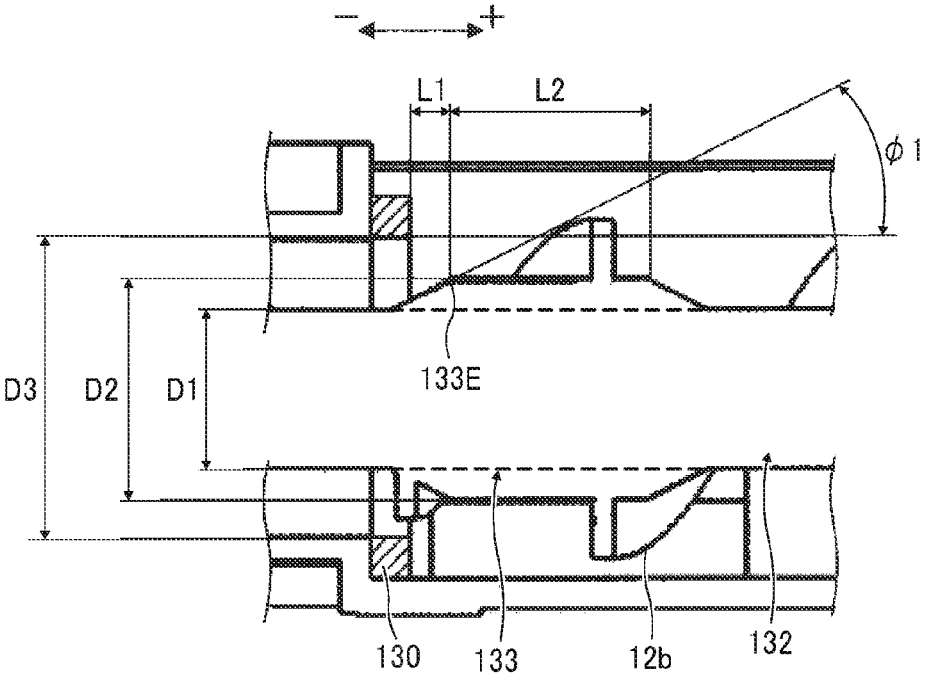
FIG. 25 is a schematic diagram illustrating dimensions of the cylindrical magnet and the first conveying screw illustrated in FIGS. 23 and 24.

While the shaft diameter is reduced by using a magnetic material for the shaft 12*b*0, increasing the length of the spiral blade 12*b* 4 of the first conveying screw 12*b* is required when developer having a low flow property is used. Accordingly, in another variation, as illustrated in FIGS. 23 and 24, in a portion (on the left in FIGS. 23 and 24) of the first conveying screw 12*b* facing the cylindrical magnet 130, the shaft diameter is changed. Specifically, as illustrated in FIG. 25, the shaft 12*b*0 includes thin portions 132 (first portions) having a diameter D1 and a thick portion 133 (a second portion) having a diameter D2 greater than the diameter D1. The cylindrical magnet 130 has an inner diameter D3 greater than the diameter D2. In FIG. 25, the thick portion 133 has an end 133E (i.e., a corner) on the side of the cylindrical magnet 130. In the axial direction of the first conveying screw 12*b*, a distance L1 represents the distance from the cylindrical magnet 130 to the end 133E of the thick portion 133, and the thick portion 133 has a length L2. The shaft 12*b*0 further includes a tapered portion between the thick portion 133 and the thin portion 132, and the tapered portion has a tapered angle θ1.

An experiment was performed to check the leak of air while changing the above-mentioned diameter D2 and the distance L1.

The results are presented, as either "Good" or "Poor", in Table 1 below. "Good" means that air does not leak from the toner supply inlet 12*e*, and the toner supply passage 123 is not clogged with toner. "Poor" means that air leaks from the toner supply inlet 12*e*, or the toner supply passage 123 is clogged with toner.

In the experiment, the diameter D1 of the thin portion 132, the inner diameter D3 of the cylindrical magnet 130, the length L2 of the thick portion 133, and the tapered angle θ1 were constant as follows. The diameter D1 was 6 mm, the inner diameter D3 was 13 mm, the length L2 was 20 mm, and the tapered angle θ1 was 30 degrees. According to the results of the experiment, the leak of air is desirably suppressed by setting the distance L1 not longer than 2 mm when the diameter D2 is 11 mm and setting the distance L1 not longer than 0 mm when the diameter D2 is 9 mm. In the experiment, inhibition of leak of air was insufficient when the diameter D2 was equal to or smaller than 7 mm. Thus, according to the results of the experiment, the leak of air is desirably suppressed by setting the distance L1 to zero to 2 mm when the diameter D1 of the thin portion 132 is 6 mm and the diameter D2 of the thick portion 133 is 11 mm.

TABLE 1

| Condition | D1 [mm] | D2 [mm] | D3 [mm] | L1 [mm] | L2 [mm] | Angle [°] | Evaluation |
|---|---|---|---|---|---|---|---|
| 1 | 6 | 11 | 13 | 0 | 20 | 30 | Good |
| 2 | 7 | 11 | 13 | 2 | 20 | 30 | Good |
| 3 | 8 | 11 | 13 | 4 | 20 | 30 | Poor |
| 4 | 9 | 9 | 13 | 0 | 20 | 30 | Good |
| 5 | 10 | 9 | 13 | −2 | 20 | 30 | Poor |
| 6 | 11 | 7 | 13 | −2 | 20 | 30 | Poor |
| 7 | 12 | 7 | 13 | −4 | 20 | 30 | Poor |

Note that, although the first conveying screw 12*b* used in the experiment, the results of which are presented in Table 1, has the shaft made of a nonmagnetic resin, the leak of air is more preferably inhibited when the shaft is made of a magnetic material or the shaft includes a magnetic shaft core and a resin coating covering the magnetic shaft core, as described above.

The structures described above are just examples, and the various aspects of the present specification attain respective effects as follows.

Aspect A

A developing device includes a developer container, such as the casing 121, to contain developer including toner and carrier; a developer bearer, such as the developing roller 12*a*, to bear the developer on a surface thereof and transport, by rotation, the developer to a developing range facing a latent image bearer, such as the photoconductor 10; a communication opening, such as the communication opening 123*a*, formed in a wall of the developer container; and a toner conveyance passage, such as the toner supply passage 123, to be connected to the communication opening. The developing device further includes a cylindrical magnet, such as the cylindrical magnet 130, having a magnetic pole arrangement parallel to an axis of the cylindrical magnet. The cylindrical magnet is disposed such that, on a cross section perpendicular to the axis of the cylindrical magnet, a space enclosed by an inner face of the cylindrical magnet overlaps with the communication opening.

In this aspect, the cylindrical magnet (i.e., a magnet cylinder) is used to generate the magnetic field to seal the communication opening with the magnetic ears of the developer. The lines of magnetic force exerted by the cylindrical magnet curl into and concentrating inside the cylinder. Such a cylindrical magnet is disposed with the space inside the cylinder overlapping with the communication opening as viewed in the axial direction of the cylinder. As a result, compared with the comparative example in which the bar-shaped magnet is used to generate the magnetic field to seal the communication with the magnetic ears, the communication opening can be sealed with a sufficient amount of developer even when the magnetic force of the cylindrical magnet is relatively weak. Accordingly, a magnet having a relative weak magnetic force is usable, and the adverse effects on the periphery of the magnet, caused by the magnet, can be suppressed.

Thus, this structure can preferably inhibit scattering of toner caused by internal pressure rise of the developer container while suppressing adverse effects on the periphery of the magnet, caused by the magnet.

Aspect B

In aspect A, the cylindrical magnet is disposed on an inner wall face (e.g., the inner wall face 1210) of the developer container defining the communication opening.

According to this aspect, the magnetic force lines curling from inside the cylinder generate a magnetic field to collect the developer entirely inside the cylinder. Accordingly, the communication opening can be sealed on the side of the developer container, with the developer. Accordingly, this structure can preferably inhibit scattering of toner caused by internal pressure rise of the developer container.

Aspect C

The developing device according to Aspect A or B further includes a conveying screw, such as the first conveying screw 12*b*, disposed in the developer container to stir and convey the developer therein. The conveying screw is inserted inside the cylindrical magnet so that the inner face of the cylindrical magnet faces the surrounds the conveying screw.

According to this aspect, the developer collected by the cylindrical magnet is magnetically retained by the magnetic ears generated in the gap between the inner face of the cylindrical magnet and the shaft (e.g., the shaft 12*b*0) of the conveying screw. Therefore, the gap between the shaft of the conveying screw and the communication opening is filled in, with the developer collected by the magnetic force of the cylindrical magnet. In this state, the developer container is shut off from the toner conveyance passage communicating with the communication opening, and the air is prevented from leaking out the developer container through the communication opening. Accordingly, this structure can preferably inhibit scattering of toner caused by internal pressure rise of the developer container.

Aspect D

In Aspect C, the shaft of the conveying screw is made of a magnetic material.

When the shaft of the conveying screw is made of a magnetic material, a portion of the shaft of the conveying screw facing the cylindrical magnet is magnetized by the magnetic field, and the developer is attracted and adheres to the magnetized portion of the shaft. With this structure, compared with a case where the conveying screw has a shaft made of a nonmagnetic material, the gap between the shaft of the conveying screw and the cylindrical magnet is preferably filled with the developer even when the shaft is relatively thin.

Aspect E

In Aspect C or D, the shaft of the conveying screw includes a magnetic portion, such as the magnetic shaft core 12*b*1, and a nonmagnetic coating, such as the coating 12*b*2, covering the magnetic portion.

According to this aspect, the diameter of the shaft is adjustable by the thickness of the coating 12*b*2 at a relatively low cost. With this structure, compared with a case where the conveying screw has a shaft made of a nonmagnetic material, the gap between the shaft of the conveying screw and the cylindrical magnet is preferably filled with the developer even when the shaft is relatively thin.

Aspect F

In any one of Aspects C through E, the conveying screw includes a first portion (e.g., the thin portion 132) having a first diameter and a second portion (e.g., the thick portion 133) having a second diameter larger than the first diameter. When the first diameter is 6 mm and the second diameter is 11 mm, a distance (e.g., the distance L1) from the cylindrical magnet to an end (e.g., the end 133E) of the second portion on the side of the cylindrical magnet in the axial direction of the conveying screw is 0 to 2 mm.

According to this aspect, while the conveying screw has the first portion having a smaller shaft diameter and a wider spiral blade (length of the blade in the direction extending from the shaft to the contour of the conveying screw is larger), the developer desirably seals the clearance between the conveying screw and the inner wall face of the developer container surrounding the conveying screw.

Aspect G

An image forming apparatus includes a latent image bearer, such as the photoconductor 10, and the developing device, such as the developing device 12, according to any one of Aspects A through F, to develop a latent image on the latent image bearer with the toner into a toner image.

This aspect prevents or reduces stains with toner inside the image forming apparatus.

Aspect H

The image forming apparatus according to Aspect G includes a transfer device, such as the transfer device 17, to transfer the toner image from the latent image bearer onto a transfer medium; a cleaning device, such as the cleaning device 14, to collect a substance (including toner) adhering to a surface of the latent image bearer after transferring of the toner image; a toner conveyance device, such as the toner conveyance device 50, to supply toner to the developing device; and a waste-toner container, such as the waste-toner container 41, to store waste toner collected by the cleaning device. The toner conveyance device includes a collected-toner passage (e.g., the collected-toner passage 55) to convey the toner collected by the cleaning device. The collected-toner passage branches into a waste-toner passage (e.g., the waste-toner passage 56) coupled to the waste-toner container and a collected-toner supply passage (e.g., the collected-toner supply passage 52) coupled to the toner conveyance passage (e.g., the toner supply passage 123) to supply toner to the developing device. The image forming apparatus further includes a passage selector (e.g., the shutter 54) to guide the collected toner inside the collected-toner passage to one of the collected-toner supply passage and the waste-toner passage.

According to this aspect, under such a condition that the toner collected by the cleaning device includes a large amount of dust (e.g., paper dust), the collected toner is conveyed to the waste-toner container 41. Thus, introduction of dust into the developing device is inhibited. By contrast, under such a condition that the amount of dust mixed in the collected toner is small, the collected toner is conveyed to the developing device 12. Thus, the collected toner is reused, thereby reducing the consumption of toner.

In this aspect, although the developing device is coupled, via the collected-toner passage, to the waste-toner container, the communication opening between the developing device and the collected-toner passage is sealed with the developer. Accordingly, a rise of pressure inside the developing device is not transmitted via the collected-toner passage to the waste-toner container. This aspect inhibits leak of toner, together with air, from the connection between the toner conveyance device and the waste-toner container. Accordingly, the waste toner inside the waste-toner container is prevented from scattering inside the image forming apparatus and from contaminating the interior of the image forming apparatus.

Aspect N

A process cartridge that is removably installable in an image forming apparatus includes at least the latent image bearer to bear a latent image, the developing device according to any one of Aspects A through C, and a holder, such as the common holder 1A, to hold, at least, the latent image bearer and the developing device.

With use of the process cartridge according to this aspect, contamination with toner inside the image forming apparatus is inhibited.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a developer container to contain developer including toner and magnetic carrier;

a developer bearer to carry, by rotation, the developer to a developing range facing a latent image bearer;

a communication opening in a wall defining the developer container;

a toner conveyance passage connected to the communication opening; and a cylindrical magnet having a magnetic pole arrangement parallel to an axis of the cylindrical magnet, the cylindrical magnet disposed to enclose a space overlapping with the communication opening, on a cross section perpendicular to the axis of the cylindrical magnet.

2. The developing device according to claim 1, wherein the cylindrical magnet is disposed on an inner wall face of the developer container defining the communication opening.

3. The developing device according to claim 1, further comprising a conveying screw disposed in the developer container to stir and convey the developer in the developer container, wherein the conveying screw is inserted inside the cylindrical magnet.

4. The developing device according to claim 3, wherein the conveying screw has a shaft made of a magnetic material.

5. The developing device according to claim 3, wherein the conveying screw has a shaft including a magnetic portion and a nonmagnetic coating covering the magnetic portion.

6. The developing device according to claim 3, wherein the conveying screw includes:

a first portion having a first diameter; and a second portion having a second diameter greater than the first diameter, wherein, when the first diameter is 6 mm and the second diameter is 11 mm, a distance from the cylindrical magnet to an end of the second portion on a side of the cylindrical magnet in an axial direction of the conveying screw is 0 to 2 mm.

7. An image forming apparatus comprising:

the latent image bearer to bear a latent image; and the developing device according to claim 1, to develop the latent image with the toner into a toner image.

8. The image forming apparatus according to claim 7, further comprising:

a transfer device to transfer the toner image from the latent image bearer onto a transfer medium;

a cleaning device to collect a substance adhering to a surface of the latent image bearer after transferring of the toner image, the substance including the toner;

a waste-toner container to store waste toner collected by the cleaning device;

a toner conveyance device to supply the toner to the developing device, the toner conveyance device including a collected-toner passage through which collected toner collected by the cleaning device is conveyed, the collected-toner passage branching into:

a waste-toner passage coupled to the waste-toner container; and a collected-toner supply passage coupled to the toner conveyance passage connected to the communication opening of the developing device; and a passage selector to guide the collected toner inside the collected-toner passage to one of the waste-toner passage and the collected-toner supply passage.

9. A process cartridge to be removably installed in an image forming apparatus, the process cartridge comprising:

the latent image bearer to bear a latent image;

the developing device according to claims 1; and a holder to hold the latent image bearer and the developing device.

* * * * *